US008486225B2

(12) United States Patent
Aono et al.

(10) Patent No.: US 8,486,225 B2
(45) Date of Patent: Jul. 16, 2013

(54) BLEACHED FIBER PRODUCT PRODUCTION METHOD, APPARATUS TO BE USED THEREFOR, AND BLEACHED FIBER PRODUCT PRODUCED THEREBY

(76) Inventors: Shigenori Aono, Imabari (JP); Koichi Abe, Imabari (JP); Keigo Takeda, Imabari (JP)

( * ) Notice: Subject to any disclaimer, the term of this patent is extended or adjusted under 35 U.S.C. 154(b) by 439 days.

(21) Appl. No.: 12/528,534

(22) PCT Filed: Dec. 26, 2007

(86) PCT No.: PCT/JP2007/074977

§ 371 (c)(1),
(2), (4) Date: Aug. 25, 2009

(87) PCT Pub. No.: WO2008/105132

PCT Pub. Date: Sep. 4, 2008

(65) Prior Publication Data

US 2010/0116450 A1 May 13, 2010

(30) Foreign Application Priority Data

Feb. 27, 2007 (JP) ..... 2007-047714
May 9, 2007 (WO) ..... PCT/JP2007/059596
Dec. 6, 2007 (JP) ..... 2007-316229

(51) Int. Cl.
*D21C 7/14* (2006.01)

(52) U.S. Cl.
USPC ..... 162/49; 162/248; 162/264; 162/263; 8/149.1; 8/149.2; 134/13; 134/2; 134/10; 430/329

(58) Field of Classification Search
USPC ..... 8/149.1, 149.2; 162/49, 263, 264, 162/248; 134/13
See application file for complete search history.

(56) References Cited

U.S. PATENT DOCUMENTS 4,959,124 A * 9/1990 Tsai ..... 162/65
6,132,629 A * 10/2000 Boley ..... 210/760
6,571,585 B1 * 6/2003 Wasinger ..... 68/5 C
6,620,210 B2 * 9/2003 Murphy et al. ..... 8/149.1

(Continued)

FOREIGN PATENT DOCUMENTS

CN 1483097 A 3/2004
JP 7-11565 1/1995

(Continued)

OTHER PUBLICATIONS

Spartan Environmental Technologies, http://www.spartanwatertreatment.com/ozone-measurement-units.html.*

(Continued)

*Primary Examiner* — Jacob Thomas Minskey
(74) *Attorney, Agent, or Firm* — Kratz, Quintos & Hanson, LLP

(57) ABSTRACT

An inventive method includes the steps of: loading a fiber product in an appropriate form into a treatment vessel; wetting the fiber product; forcibly circulating an ozone-containing liquid in contact with the wetted fiber product to thereby bleach the fiber product; and forcibly circulating an ozone decomposing chemical agent liquid in contact with the ozone-treated fiber product to decompose ozone. This method ensures efficient bleaching of the fiber product with the ozone. Further, the method is advantageous in that the resulting bleached fiber product is less liable to be yellowed over time.

24 Claims, 5 Drawing Sheets

U.S. PATENT DOCUMENTS

| | | | | |
|---|---|---|---|---|
| 2003/0108823 | A1* | 6/2003 | Muraoka et al. | 430/329 |
| 2004/0049858 | A1 | 3/2004 | Thoma et al. | 8/400 |
| 2005/0115004 | A1* | 6/2005 | Tashiro et al. | 8/102 |

FOREIGN PATENT DOCUMENTS

| | | | |
|---|---|---|---|
| JP | 7-207572 | | 8/1995 |
| JP | 9-31840 | | 2/1997 |
| JP | 2001-164458 | A1 | 6/2001 |
| JP | 2002-105849 | A1 | 4/2002 |
| JP | 2003-340247 | A1 | 12/2003 |
| JP | 2005-246255 | A1 | 9/2005 |
| JP | 2005-294377 | A1 | 10/2005 |
| WO | WO 97/06305 | A1 | 2/1997 |
| WO | WO 03/097916 | A1 | 11/2003 |

OTHER PUBLICATIONS

International Search Report for International Application PCT/JP2007/074977 dated Apr. 7, 2008.

Chinese Office Action dated Jun. 14, 2011, in counterpart application CN200780014816.

* cited by examiner

BLEACHED FIBER PRODUCT PRODUCTION METHOD, APPARATUS TO BE USED THEREFOR, AND BLEACHED FIBER PRODUCT PRODUCED THEREBY

TECHNICAL FIELD

The present invention relates to a bleached fiber product production method for bleaching a fiber product such as a fabric, an apparatus to be used therefor, and a bleached fiber product produced thereby.

BACKGROUND ART

Conventionally, a chlorine-containing bleaching agent such as sodium hypochlorite or sodium chlorite is often used for a bleaching treatment for bleaching a fiber product. However, the bleaching treatment using the chlorine-containing agent requires a strict monitoring system and a treatment facility with the possibility that a treatment liquid containing a highly toxic chlorine compound is drained. This disadvantageously leads to higher costs.

Lately, a more environmentally-friendly bleaching treatment is often performed by using hydrogen peroxide instead of the chlorine-containing bleaching agent. If metal ions are present, however, hydrogen peroxide is decomposed due to the catalytic action of the metal ions, resulting in embrittlement of the fiber product. This disadvantageously impairs the texture of the fiber product. These conventional bleaching treatments are each performed by immersing the fiber product in a treatment liquid containing not only the bleaching agent but also a refining agent at a higher temperature, for example, on the order of 80° C. to 120° C. for a long period of time, thereby requiring significantly higher costs for chemical agents and energy. Further, these bleaching treatments are ecologically problematic.

On the other hand, novel bleaching methods employing ozone ($O_3$) are proposed, some of which have been put into practical use (see Patent Documents 1 to 3).

Patent Document 1: JP-A-HEI9 (1997)-31840
Patent Document 2: JP-A-2001-164458
Patent Document 3: JP-A-HEI7 (1995)-11565

DISCLOSURE OF THE INVENTION

Problems to be Solved by the Invention

The ozone is a safe substance existing in the nature, and is self-decomposed into oxygen ($O_2$) when being allowed to stand, so that no toxicity remains. The bleaching methods employing ozone are advantageous in that a waste water treatment is less costly than in the bleaching methods employing the chlorine-containing bleaching agent and the like.

In the bleaching methods disclosed in Patent Documents 1 and 2, however, a web-form fiber product is continuously transported to be brought into contact with an ozone-containing gas in a treatment vessel. For prevention of leakage of the ozone-containing gas, gas-tightness should be ensured at inlet and output ports through which the fiber product is loaded into and unloaded from the treatment vessel. This requires advanced assembling/maintenance techniques. The ozone is indeed self-decomposable, but is a toxic gas in an undecomposed state. Accordingly, there are stringent environmental standards for the ozone. Particularly, the fiber product resulting from the bleaching treatment with the ozone-containing gas is prone to yellowing over time. For prevention of the yellowing, Document 1 proposes to wash the bleached fiber product with hot water, and Document 2 proposes to secondarily bleach the bleached fiber product with hydrogen peroxide. Therefore, it is necessary to transfer the fiber product containing residual unreacted ozone to these subsequent steps. With higher costs associated with the sealing of the ozone-containing gas, these methods are not feasible. In addition, these methods also fail to perfectly prevent the over-time yellowing of the fiber product.

On the other hand, a bleaching apparatus disclosed in Patent Document 3 is configured such that a packaged fiber product is treated in a batch treatment vessel. In the apparatus, an ozone-containing treatment liquid is forcibly circulated in contact with the fiber product to bleach the fiber product. With this apparatus, ozone is less liable to leak out. In practice, however, treatment conditions for the ozone bleaching and a method for preventing the over-time yellowing of the ozone-bleached fiber product are not sufficiently contemplated and, therefore, this apparatus is not feasible.

In view of the foregoing, it is an object of the present invention to provide a bleached fiber product production method which is capable of efficiently treating a fiber product with an ozone-containing liquid to produce an excellent bleached fiber product substantially free from over-time yellowing, and to provide an apparatus to be used for the production method and a bleached fiber product produced by the production method.

Means for Solving the Problems

According to a first aspect of the present invention to achieve the aforementioned object, there is provided a bleached fiber product production method for bleaching a fiber product mainly including at least one of a natural fiber and a regenerated fiber to produce a bleached fiber product, the method comprising the steps of: loading the fiber product into a lidded hermetic vessel serving as a treatment vessel; forcibly circulating a treatment liquid in contact with the fiber product loaded in the treatment vessel through a forcible circulation pipe attached to the treatment vessel to thereby wet the fiber product; supplying an ozone gas into the treatment liquid to provide an ozone-containing liquid, and forcibly circulating the ozone-containing liquid in contact with the wetted fiber product through the forcible circulation pipe to thereby bleach the fiber product; forcibly circulating an ozone decomposing chemical agent liquid in contact with the bleached fiber product through the forcible circulation pipe to thereby decompose ozone; and rinsing the fiber product after the decomposition of the ozone; wherein an ozone concentration in the treatment vessel is measured over time in the fiber product bleaching step, and maintained at a constant ozone concentration level by increasing an ozone gas supply amount if the measured concentration is lower than a predetermined range, and reducing the ozone gas supply amount if the measured concentration is higher than the predetermined range.

According to a second aspect of the present invention, there is provided a bleached fiber product production method for bleaching a fiber product mainly including at least one of a natural fiber and a regenerated fiber to produce a bleached fiber product, the method comprising the steps of: loading the fiber product into a lidded hermetic vessel serving as a treatment vessel; forcibly circulating a treatment liquid in contact with the fiber product loaded in the treatment vessel through a forcible circulation pipe attached to the treatment vessel to thereby wet the fiber product; supplying an ozone gas into the treatment liquid to provide an ozone-containing liquid, and forcibly circulating the ozone-containing liquid in contact with the wetted fiber product through the forcible circulation pipe to thereby bleach the fiber product; forcibly circulating hot water heated up to a temperature not lower than 50° C. in contact with the bleached fiber product through the forcible circulation pipe to thereby yellow the bleached fiber product; forcibly circulating an ozone decomposing chemical agent liquid in contact with the yellowed fiber product through the forcible circulation pipe to thereby simultaneously achieve removal of a yellowing substance from the yellowed fiber product and decomposition of ozone; and rinsing the fiber product after the removal of the yellowing substance and the decomposition of the ozone; wherein an ozone concentration in the treatment vessel is measured over time in the fiber product bleaching step, and maintained at a constant ozone concentration level by increasing an ozone gas supply amount if the measured concentration is lower than a predetermined range, and reducing the ozone gas supply amount if the measured concentration is higher than the predetermined range.

According to a third aspect of the present invention, in particular, the treatment vessel is a package type treatment vessel in which the fiber product is treated in a packaged form, and the treatment liquid, the ozone-containing liquid, the hot water and the ozone decomposing chemical agent liquid are each caused to repeatedly flow into and out of the packaged fiber product to be forcibly circulated in contact with the fiber product in the bleached fiber product production method. According to a fourth aspect of the present invention, the treatment vessel is a liquid flow type treatment vessel in which the fiber product is transported in a rope form in a liquid stream while being treated in the liquid stream, and the treatment liquid, the ozone-containing liquid, the hot water and the ozone decomposing chemical agent liquid are each used for generating the liquid stream for transportation of the rope-form fiber product and forcibly circulated in contact with the fiber product in the bleached fiber product production method. According to a fifth aspect of the present invention, the treatment vessel is a washer type treatment vessel in which the fiber product is treated while being moved in a rotary drum, and the treatment liquid, the ozone-containing liquid, the hot water and the ozone decomposing chemical agent liquid are each forcibly circulated into and out of the rotary drum in contact with the fiber product in the bleached fiber product production method.

According to a sixth aspect of the present invention, in particular, the ozone-containing liquid has an ozone concentration of 10 to 300 g/Nm$^3$, and the ozone-containing liquid is forcibly circulated at a flow rate of 15 to 90 liters/minute per 1 kg of the fiber product in the bleached fiber product production method. According to a seventh aspect of the present invention, the ozone decomposing chemical agent liquid is a chemical agent liquid mainly containing hydrogen peroxide and an alkali agent in the bleached fiber product production method. According to an eighth aspect of the present invention, the ozone decomposing chemical agent liquid includes a first chemical agent liquid mainly containing a reducing agent and a second chemical agent liquid mainly containing hydrogen peroxide and an alkali agent in the bleached fiber product production method.

According to a ninth aspect of the present invention, in particular, an ozone-containing waste liquid drained out of the treatment vessel and an ozone-containing waste gas discharged out of the treatment vessel are introduced into an alkali aqueous solution tank so that ozone contained in the waste liquid and the waste gas is decomposed in an alkali aqueous solution in the bleached fiber product production method. According to a tenth aspect of the present invention, a gas present above a liquid surface in the alkali aqueous solution tank is collected to be introduced into a chimney heated up to a temperature not lower than 200° C. so that ozone contained in the collected gas is thermally decomposed by heat in the chimney in the bleached fiber product production method.

According to an eleventh aspect of the present invention, there is provided a fiber product bleaching apparatus to be used for the bleached fiber product production method according to the first aspect, the apparatus comprising: a lidded hermetic vessel serving as a treatment vessel; fiber product holder means for loading a fiber product in the treatment vessel; liquid introducing means for introducing a liquid to the fiber product loaded in the treatment vessel; a forcible liquid circulation pipe through which the liquid introduced into the treatment vessel is repeatedly taken out of the treatment vessel and introduced again into the treatment vessel to be thereby circulated in contact with the fiber product loaded in the treatment vessel; ozone gas supplying means which supplies an ozone gas into the liquid circulated through the forcible liquid circulation pipe to provide an ozone-containing liquid for a bleaching treatment; chemical agent liquid preparing means which supplies an ozone decomposing agent into the liquid circulated through the forcible liquid circulation pipe to provide an ozone decomposing chemical agent liquid for decomposing ozone; a liquid outlet pipe through which the liquid present in the treatment vessel is drained out of the treatment vessel; and a gas outlet pipe through which a gas present in the treatment vessel is discharged out of the treatment vessel; wherein an ozone concentration sensor is provided in the treatment vessel for measuring an ozone concentration in the treatment vessel over time, and the ozone concentration in the treatment vessel is controlled to be maintained at a constant ozone concentration level by increasing an ozone gas supply amount if the measured concentration is lower than a predetermined range, and reducing the ozone gas supply amount if the measured concentration is higher than the predetermined range.

According to a twelfth aspect of the present invention, there is provided a fiber product bleaching apparatus to be used for the bleached fiber product production method according to the second aspect, the apparatus comprising: a lidded hermetic vessel serving as a treatment vessel; fiber product holder means for loading a fiber product in the treatment vessel; liquid introducing means for introducing a liquid to the fiber product loaded in the treatment vessel; a forcible liquid circulation pipe through which the liquid introduced into the treatment vessel is repeatedly taken out of the treatment vessel and introduced again into the treatment vessel to be thereby circulated in contact with the fiber product loaded in the treatment vessel; ozone gas supplying means which supplies an ozone gas into the liquid circulated through the forcible liquid circulation pipe to provide an ozone-containing liquid for a bleaching treatment; heating means which heats the liquid circulated through the forcible liquid circulation pipe up to a temperature not lower than 50° C. to provide hot water for a yellowing treatment; chemical agent liquid preparing means which supplies an ozone decomposing agent into the liquid circulated through the forcible liquid circulation pipe to provide an ozone decomposing chemical agent liquid for simultaneously achieving removal of a yellowing substance and decomposition of ozone; a liquid outlet pipe through which the liquid present in the treatment vessel is drained out of the treatment vessel; and a gas outlet pipe through which a gas present in the treatment vessel is discharged out of the treatment vessel; wherein an ozone concentration sensor is provided in the treatment vessel for measuring an ozone concentration in the treatment vessel over time, and the ozone concentration in the treatment vessel is controlled to be maintained at a constant ozone concentration level by increasing an ozone gas supply amount if the measured concentration is lower than a predetermined range, and reducing the ozone gas supply amount if the measured concentration is higher than the predetermined range.

According to a thirteenth aspect of the present invention, in particular, the treatment vessel is a package type treatment vessel in which the fiber product is treated in a packaged form, and the liquid forcibly circulated through the forcible liquid circulation pipe is caused to repeatedly flow into and out of the packaged fiber product to be brought into contact with the fiber product in the fiber product bleaching apparatus. According to a fourteenth aspect of the present invention, the treatment vessel is a liquid flow type treatment vessel in which the fiber product is transported in a rope-form in a liquid stream while being treated in the liquid stream, and the liquid forcibly circulated through the forcible liquid circulation pipe is used for generating the liquid stream for transportation of the rope-form fiber product and brought into contact with the fiber product in the fiber product bleaching apparatus. According to a fifteenth aspect of the present invention, the treatment vessel is a washer type treatment vessel in which the fiber product is treated while being moved in a rotary drum, and the liquid forcibly circulated through the forcible liquid circulation pipe is forcibly circulated into and out of the rotary drum in contact with the fiber product in the fiber product bleaching apparatus.

According to a sixteenth aspect of the present invention, in particular, the ozone gas supply means includes an ozone gas generator, an ozone gas supply pipe extending from the ozone gas generator, and a gas-liquid mixing/ejecting means selected from an ejector, a vortex pump and a mixing pump, and the ozone gas is supplied in a minute bubble form into the circulated liquid via the gas-liquid mixing/ejecting means in the fiber product bleaching apparatus. According to a seventeen aspect of the present invention, a distal end of the liquid outlet pipe and a distal end of the gas outlet pipe each communicate with an alkali aqueous solution tank in the fiber product bleaching apparatus.

According to an eighteenth aspect of the present invention, in particular, a gas present above a liquid surface in the alkali aqueous solution tank is collected to be fed into a chimney heated up to a temperature not lower than 200° C. in the fiber product bleaching apparatus. According to a nineteenth aspect of the present invention, an inner peripheral surface of the treatment vessel and an inner peripheral surface of a pipe through which the ozone-containing liquid and the ozone-containing gas flow are each coated with a fluorine-containing resin in the fiber product bleaching apparatus.

According to a twentieth aspect of the present invention, there is provided a bleached fiber product produced by any of the production methods according to the first to tenth aspects. According to a twenty-first aspect of the present invention, in particular, the bleached fiber product has a whiteness of not lower than 60 (as measured in conformity with JIS-1991) after being allowed to stand at 20° C. to 30° C. for 60 days following the production.

Effects of the Invention

In the inventive bleached fiber product production methods, the fiber product is bleached with ozone which is immediately decomposed and unlikely to remain in an ambient environment. Therefore, the production method is advantageous with a lower environmental load. Further, the ozone bleaching is ecological in that the amounts of the chemical agents to be used and the energy consumption are reduced as compared with a case in which a conventional bleaching agent such as a chlorine-containing agent is used. In the inventive production methods, the ozone-containing liquid having a constant ozone concentration is forcibly circulated in contact with the fiber product loaded in any of various forms into the treatment vessel to bleach the fiber product. Thus, the inventive production methods are advantageous in that the bleaching treatment can be efficiently and evenly performed.

Since the aforementioned treatment is performed in the hermetic vessel, undecomposed ozone is unlikely to leak out. Thus, the working environment can be kept intact. The fiber product is bleached under relatively gentle conditions and, therefore, is less liable to be degraded. Thus, the bleached fiber product advantageously has a smooth texture. In addition, even if a yellowing substance is produced in the fiber product due to contact between the fiber product and air in the bleaching step, the removal of the yellowing substance can be achieved simultaneously with the decomposition of the ozone in the ozone decomposing step using the ozone decomposing chemical agent liquid after the bleaching step. Therefore, the inventive methods are highly effective in that the resulting bleached fiber product is unlikely to be yellowed over time. In order to prevent the yellowing substance from remaining in the final product or from being increasingly produced over time after the bleached fiber product is produced, the yellowing is intentionally caused with the use of the hot water after the ozone bleaching step before the ozone decomposing step. Thus, the produced yellowing substance is removed in the ozone decomposing step, whereby the over-time yellowing of the fiber product is more sufficiently prevented.

The inventive fiber product bleaching apparatus is provided simply by modifying a conventional package type treatment apparatus, a conventional liquid flow type treatment apparatus and a conventional washer type treatment apparatus, so that facility costs are minimized. The bleaching apparatus is capable of producing a bleached fiber product having an excellent texture and substantially free from the over-time yellowing or free from the yellowing.

The bleached fiber products produced by the inventive production methods each have an excellent texture and a high quality, and is substantially free from the over-time yellowing or free from the yellowing.

Figure 1:
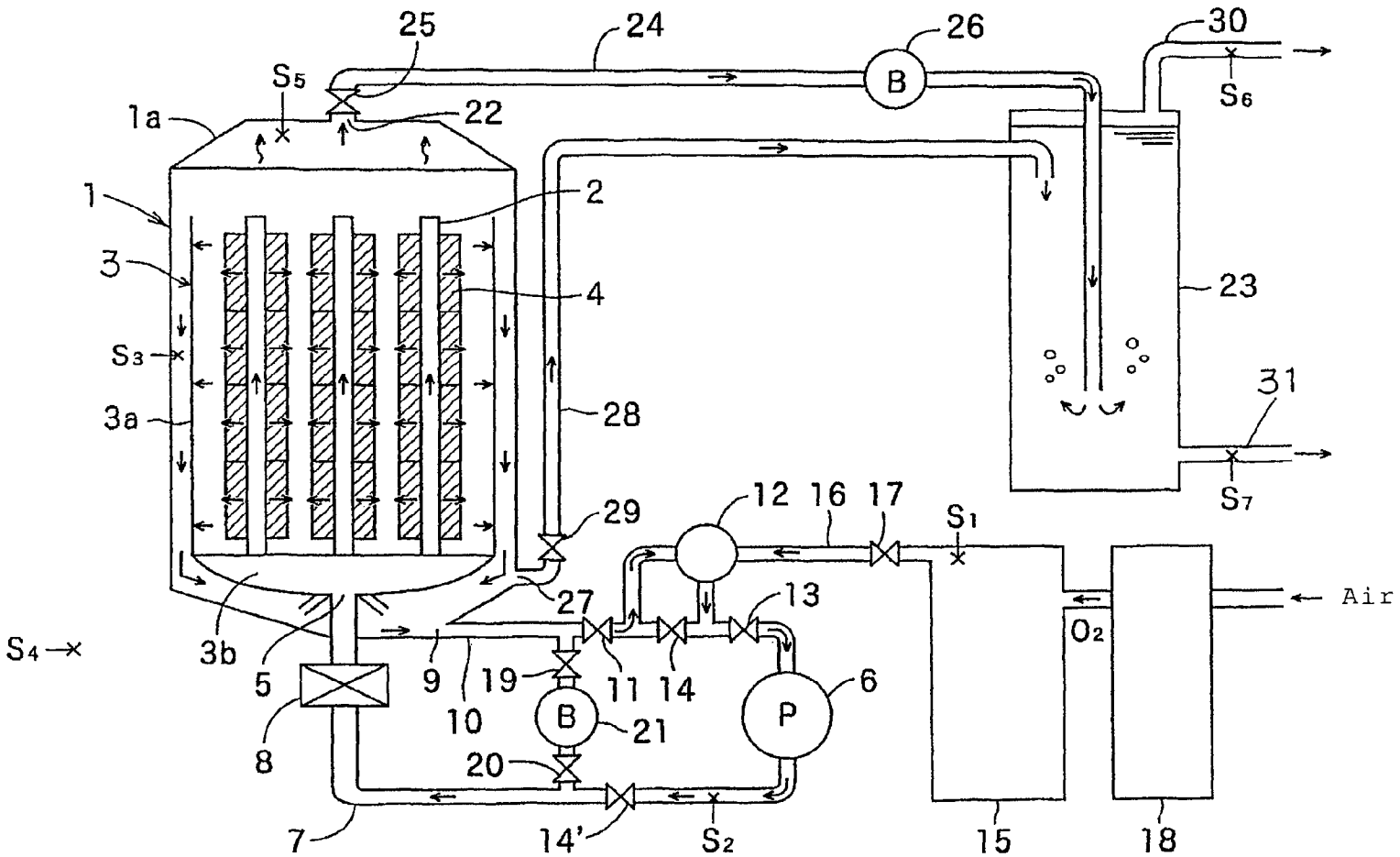
FIG. 1 is a structural diagram of a bleaching apparatus to be used in one embodiment of the present invention.

| DESCRIPTION OF REFERENCE CHARACTERS | |
|---|---|
| 1: | TREATMENT VESSEL |
| 4: | FIBER PRODUCT |
| 6: | CIRCULATION PUMP |
| 15: | OZONE GENERATOR |
| $S_1$-$S_3$: | OZONE SENSORS |

BEST MODE FOR CARRYING OUT THE INVENTION

The best mode for carrying out the invention will hereinafter be described in detail.

Examples of a fiber intended by the present invention include fibers mainly including natural fibers such as of cotton, hemp and wool, and regenerated fibers such as of viscous rayon, which conventionally require a bleaching treatment. These fibers may be used in combination. The expression "mainly including" as herein used means that a fiber product may include any of these fibers alone, or may include any of these fibers and other fiber in combination. In the latter case, the other fiber to be employed in combination with any of these natural and regenerated fibers is present in a proportion of less than 50 wt % based on the overall weight of the fiber product.

The form of the fiber product intended by the present invention is not particularly limited, but examples thereof include loose stock, filaments, cotton stuff, tow, slivers, yarns, woven/knitted fabrics, and nonwoven fabrics. Alternatively, the fiber product may be in the form of a final product such as garment.

In the present invention, the form of the fiber product to be subjected to a bleaching treatment is properly determined depending upon the type of the fiber product and the type of a process to be performed by a bleaching apparatus. Where a package type bleaching apparatus is employed, for example, the loose stock is filled in an inner basket, and the yarns are packaged in a skein form, a cheese form, a cone form or the like. Further, the woven/knitted fabrics and the nonwoven fabrics are each wound around a beam or packaged in a stacked state. The garment and other products are stretched flatly and stacked one on another. Alternatively, the fiber product may be loaded in a pressed state or in a tension set state in a treatment vessel. In the case of a liquid flow type, on the other hand, the yarns and the woven/knitted fabrics are loaded in a rope form into a treatment liquid flow passage. In the case of a washer type, the woven/knitted fabrics, the nonwoven fabrics and the garments are loaded in a free state into a treatment vessel (rotary drum).

Next, one example of the fiber product bleaching apparatus to be used in the present invention is shown in FIG. 1. In FIG. 1, a reference numeral 1 denotes a vertical hermetic treatment vessel having an openable lid 1*a*. A cheese carrier 3 having a multiplicity of perforated cylindrical spindles 2 (perforations are not shown, and ditto for the following description) provided therein and a perforated plate 3*a* surrounding the spindles 2 is provided in the treatment vessel 1. A multiplicity of packaged cheese-form fiber products 4 (four fiber products) each prepared by winding a yarn around a perforated tube (not shown) are held in a stacked state by each of the spindles 2. The fiber products 4 are fixed to each of the spindles 2 by a cheese press plate and a fixing nut (not shown) provided at an upper end of the spindle 2.

A fluid inlet port 5 is provided at the center of the bottom of the treatment vessel 1 as communicating with a header portion 3*b* provided below the cheese carrier 3. A fluid supply pipe 7 extending from an outlet side of a circulation pump 6 provided outside the treatment vessel 1 is connected to the fluid inlet port 5 via a heat exchanger 8. On the other hand, a fluid outlet port 9 is provided on a lateral side of the bottom of the treatment vessel 1. A fluid outlet pipe 10 extending from the fluid outlet port 9 is connected to a liquid suction port of an ejector 12 via a gate valve 11, and an outlet side of the ejector 12 is connected to an inlet side of the circulation pump 6 via a valve 13. A reference numeral 14 denotes a gate valve for switching a flow path to a flow passage bypassing the ejector 12, and a reference numeral 14' denotes a gate valve for switching the flow path from a flow passage extending through the circulation pump 6 to a flow passage extending through a blower 21 to be described later.

An ozone gas supply pipe 16 extending from an ozone generator 15 is connected to a gas suction port of the ejector 12. A liquid and an ozone gas are mixed by the ejector 12 to be sucked in a gas-liquid mixed state into the circulation pump 6, and then introduced into the treatment vessel 1. A valve 17 for regulating the flow rate of the ozone gas is provided in the ozone gas supply pipe 16. An oxygen enriching apparatus (PSA) 18 is connected to the ozone generator 15, so that oxygen obtained from air through enrichment is supplied as an ozone gas material into the ozone generator 15.

The blower 21 is connected to the fluid outlet port 9 and the fluid supply pipe 7 via gate valves 19, 20. Forcible circulation of the liquid by the circulation pump 6 is switched to forcible circulation of the gas by the blower 21 by closing the gate valves 11, 14' and opening the gate valves 19, 20.

Further, a gas supply pipe for supplying a gas such as steam or air and a liquid supply pipe for supplying water or a cleaning liquid are connected to the fluid outlet pipe 10 via valves (not shown).

On the other hand, a waste gas port 22 through which a gas in the treatment vessel 1 is discharged from the treatment vessel 1 is provided in an upper portion of the treatment vessel 1. A waste gas pipe 24 is connected at one end thereof to the waste gas port 22 via a valve 25, and the other end portion of the waste gas pipe 24 extends into a waste liquid in an alkali waste liquid tank 23 provided in a plant. A reference numeral 26 is a blower which transports the waste gas as indicated by arrows.

A waste liquid port 27 is provided in the bottom of the treatment vessel 1 (illustrated in FIG. 1 as being provided on a lateral side for easy understanding). A waste liquid pipe 28 is connected at one end thereof to the waste liquid port 27 via a valve 29, and the other end portion of the waste liquid pipe 28, like the waste gas pipe 24, extends into the waste liquid in the alkali waste liquid tank 23.

The alkali waste liquid tank 23 is sealed, and a gas present above a liquid surface is collected and fed into a boiler chimney (not shown) provided in the plant via a pipe 30. Thus, ozone remaining in the gas is completely thermally decomposed by the heat of the boiler (e.g., not lower than 200° C.). The waste liquid in the alkali waste liquid tank 23 is transported into a water liquid treatment tank (not shown) provided in the plant via a pipe 31.

In the apparatus described above, an ozone sensor $S_1$ for measuring an ozone gas concentration is provided adjacent an ozone gas outlet port in the ozone generator 15, and ozone sensors $S_2$, $S_3$ for measuring the ozone concentration of the circulated treatment liquid are provided at two positions, i.e., in the liquid supply pipe 7 and in the treatment vessel 1, respectively. These three ozone sensors $S_1$ to $S_3$ are operative in association with each other, and function to maintain the ozone concentration of the circulated ozone-containing liquid at a constant ozone concentration level.

For safety, ozone sensors $S_4$ to $S_7$ are provided at four positions, i.e., outside the treatment vessel 1, on an inner side of the openable lid 1*a* of the treatment vessel 1, in the pipe 30 and in the pipe 31, to prevent the ozone gas from adversely affecting the environment. That is, the safety level of the ozone gas concentration is specified at 0.1 ppm by the Labor Standards Law. In conformity with the Labor Standards Law, if the ozone sensor $S_4$ provided outside the treatment vessel 1 detects 0.1 ppm, the apparatus is forcibly turned off with a judgment that the ambient working environment is jeopardized by the leak of the gas.

The ozone sensor $S_5$ provided on the inner side of the openable lid 1*a* provides an auxiliary measurement during the operation of the apparatus and, if the ozone sensor $S_5$ detects 0.1 ppm when the openable lid 1*a* is opened after the treatment, an opening operation of the openable lid 1*a* is forcibly stopped with a judgment that the ambient working environment is jeopardized by the opening of the lid.

The ozone sensors $S_6$, $S_7$ provided in the pipes 30, 31 constantly provide auxiliary measurements and, if detecting 1 ppm, provides an alert. If either of the ozone sensors $S_6$, $S_7$ detects 10 ppm, the operation of the apparatus is forcibly stopped for safety. If the ozone concentration is less than 10 ppm, the ozone in the ozone gas is completely decomposed in the boiler chimney, and the ozone in the ozone-containing waste liquid is completely decomposed in the waste liquid treatment facility.

With the use of the aforementioned apparatus, the bleaching step or the like is performed on the fiber products 4, for example, in the following manner, thereby providing bleached fiber products excellent in quality. That is, as shown in FIG. 1, the cheese carrier 3 is first loaded into the treatment vessel 1 with a multiplicity of fiber products 4 being held in a stacked state by the spindles 2. After ordinary temperature water (25° C.) is supplied at a predetermined bath ratio (e.g., 1:10) into the treatment vessel 1 from a liquid supply pipe (not shown), the circulation pump 6 is actuated to forcibly circulate the ordinary temperature water (at a liquid circulation rate of 30 liters/min per 1 kg of fiber products) to repeatedly cause the ordinary temperature water to flow from the inside to the outside of the fiber products 4. This state is maintained for 10 minutes, whereby the water is applied to the inner portions of the fiber products 4 to wet the fiber products 4.

In turn, citric acid is added in a predetermined concentration (e.g., 1 g/liter) to the circulated liquid (ordinary temperature water) which is in turn circulated for 10 minutes, whereby the pH of the circulated liquid is adjusted at an acidic pH level. This is because ozone of an ozone gas to be subsequently supplied is liable to be decomposed in an alkaline liquid.

Further, the oxygen enriching apparatus 18 and the ozone generator 15 are turned on, whereby an ozone gas containing ozone at a predetermined concentration (e.g., 100 g/Nm$^3$) is generated. At the same time, the ejector 12 is turned on, and the valve 17 is opened to permit the circulated liquid to flow through the ejector 12. Thus, the ozone gas flows through the ejector 12 to be injected into the circulated liquid, whereby the ozone gas is mixed in a minute bubble form with the circulated liquid to provide an ozone-containing liquid. At this time, the internal pressure of the ejector 12 is set at 392.4 kPa (=4 kg/cm$^2$), and the pressure is reduced to 196.2 kPa (=2 kg/cm$^2$) in a flow path extending from the ejector 12 to the valve 13, whereby the ozone gas is properly disintegrated into minute bubbles to be mixed with the circulated liquid and the resulting mixture is ejected.

The ozone-containing liquid is forcibly circulated for 30 minutes by the circulation pump 6 to repeatedly flow from the inside to the outside of the fiber products 4. Thus, a bleaching step is performed to bleach the inner portions and surface portions of the fiber products 4 by the decomposition of the ozone. In the bleaching step, the ozone gas is continuously injected into the treatment vessel 1 because the ozone is decomposed over time. As required, the valve 25 is opened and closed to transfer the gas from the treatment vessel 1 into the alkali waste liquid tank 23 through the waste gas pipe 24 to keep the internal pressure of the treatment vessel 1 at a constant pressure level.

In the ozone bleaching step, the ozone sensor $S_3$ in the treatment vessel 1, the ozone sensor $S_1$ in the ozone generator 15 and the ozone sensor $S_2$ provided at the outlet side of the circulation pump 6 are operative in association with each other to automatically control the ozone concentration at the constant level. More specifically, the ozone sensor $S_3$ and the ozone sensor $S_2$ each constantly monitor a change in the ozone concentration of the ozone-containing liquid, and ozone concentration values measured by the ozone sensor $S_3$ and the ozone sensor $S_2$ are corrected for a difference therebetween. If the corrected values are lower by 10% than a predetermined reference concentration level, the ozone gas generation rate of the ozone generator 15 is increased until the measurement value of the ozone sensor $S_1$ reaches an upper limit level. Conversely, if the measurement values (corrected values) of the ozone sensor $S_3$ and the ozone sensor $S_2$ are higher by 10% than the predetermined reference concentration level, the ozone gas generation rate of the ozone generator 15 is reduced until the measurement value of the ozone sensor $S_1$ reaches a lower limit level. Thus, the ozone concentration in the ozone-containing liquid is kept constant. The apparatus is preferably configured so as to be entirely stopped if the measurement value of the ozone sensor $S_3$ is abnormal (for example, ±50% with respect to the reference concentration level).

After completion of the bleaching step, the circulated liquid (ozone-containing liquid) is drained out of the treatment vessel 1 through the drain pipe 28, and then caused to flow through the alkali waste liquid (typically having a pH of 10 to 11) in the alkali waste liquid tank 23, whereby ozone contained in the liquid is decomposed in the presence of the alkali for detoxification. As described above, the gas present above the liquid surface in the alkali waste liquid tank 23 is transferred into the boiler chimney provided in the plant to be thereby completely thermally decomposed by the heat of the boiler.

Figure 2:
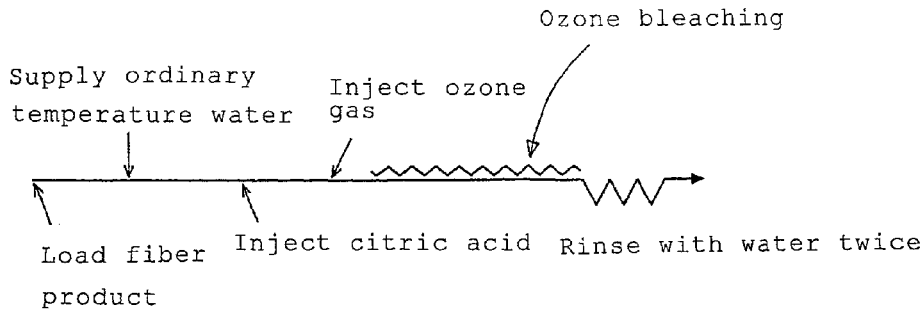
FIG. 2 is a process diagram showing some steps according to the embodiment.

After the drainage, the ordinary temperature water is newly supplied into the treatment vessel 1 through the liquid supply pipe, then forcibly circulated for 5 minutes, and drained for water rinsing. This water rinsing step is repeated twice. Thus, ozone remaining in the treatment vessel 1 is removed to some extent. A process diagram for a process sequence up to this step is shown in FIG. 2.

Subsequently, the ordinary temperature water is supplied into the treatment vessel 1 through the liquid supply pipe and heated up to 80° C. while being forcibly circulated by the circulation pump 6, thereby providing hot water. Then, the hot water is forcibly circulated for 10 minutes to be repeatedly caused to flow from the inside to the outside of the fiber products 4. The heat of the hot water promotes a reaction such that the ozone reacts with nitrogen atoms of fibers and ambient hydroxyl groups to provide nitrogen compounds, whereby the fiber products 4 are yellowed. The conventionally observed over-time yellowing of a product surface of a bleached fiber product is attributable to this yellowing reaction. It is highly desirable to prevent the yellowing. In this embodiment, the yellowing is intentionally caused, and then the residual ozone and a yellowing substance resulting from the yellowing reaction are simultaneously decomposed to be removed in an ozone decomposing step to be described later. Thus, the fiber products are thereafter free from the yellowing.

After the yellowing step is thus performed, the circulated liquid (hot water) is drained out of the treatment vessel 1 through the drainpipe 28, and the ozone is decomposed in the alkali waste liquid tank 23 for detoxification.

Figure 3:
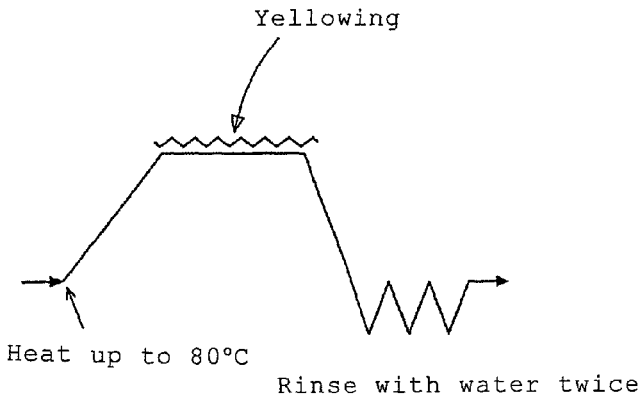
FIG. 3 is a process diagram showing another step according to the embodiment.

After the drainage, the ordinary temperature water is newly supplied into the treatment vessel 1 through the liquid supply pipe, and then forcibly circulated for 5 minutes and drained for water rinsing. This water rinsing step is repeated twice. Thus, ozone remaining in the treatment vessel 1 is further removed. A process diagram for a process sequence up to this step is shown in FIG. 3.

Subsequently, the ordinary temperature water is supplied into the treatment vessel 1 through the liquid supply pipe and heated up to 90° C. while being forcibly circulated by the circulation pump 6. Then, a chemical agent of the following recipe is fed into the circulated water for preparation of an ozone decomposing chemical agent liquid. The chemical agent liquid is forcibly circulated for 15 minutes, whereby the chemical agent liquid is repeatedly caused to flow from the inside to the outside of the fiber products 4. Thus, the residual ozone and the yellowing substance intentionally produced in the preceding step are simultaneously decomposed to be removed.

| Recipe for Ozone Decomposing Chemical Agent Liquid | |
|---|---|
| Hydrogen peroxide | 2 to 6 g/liter |
| Sodium hydroxide | 1 to 4 g/liter |
| Surface active agent | 1 g/liter |
| Stabilizer | 1 g/liter |

After the ozone decomposing step and the yellowing removing step are thus performed, the circulated liquid (chemical agent liquid) is drained out of the treatment vessel 1 through the drain pipe 28, and decomposed in the alkali waste liquid tank 23 for detoxification.

Figure 4:
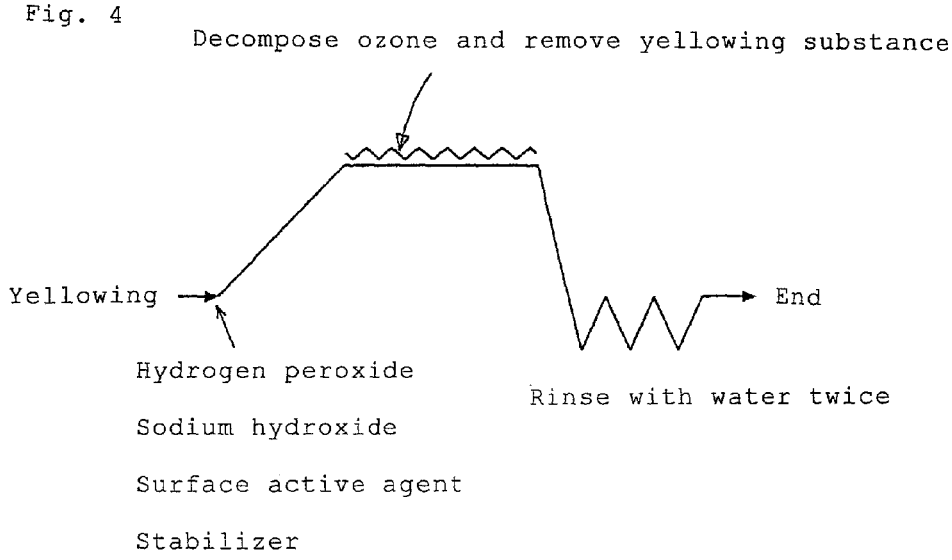
FIG. 4 is a process diagram showing further steps according to the embodiment.

After the drainage, the ordinary temperature water is newly supplied into the treatment vessel 1 through the liquid supply pipe, and then forcibly circulated for 5 minutes and drained for water rinsing. This water rinsing step is repeated twice, whereby ozone remaining in the treatment vessel 1 is further removed. Thus, a treatment process is completed. A process diagram for a process sequence up to this step is shown in FIG. 4.

Subsequently, the water used for the water rinsing step is drained, and the blower 21 is connected to the treatment vessel 1 by switching the gate valves 11, 14' and the gate valves 19, 20. Then, the blower 21 is turned on to increase the internal pressure of the treatment vessel 1, whereby the fiber products 4 are pressure-dehydrated. In turn, the openable lid 1*a* is opened, and the fiber products 4 are unloaded together with the cheese carrier 3 from the treatment vessel 1 and loaded into a separate drying apparatus to be thereby dried. Conditions for the drying are properly determined according to the type and the form of the fiber products 4. Thus, the intended bleached fiber products can be provided.

The aforementioned method is advantageous with a lower environmental load, because the fiber products 4 are bleached under the relatively gentle conditions with the use of the ozone which is immediately decomposed and is unlikely to remain in the environment. The ozone-containing liquid is forcibly circulated to be forcibly brought into contact with the inner portions of the packaged fiber products 4 to bleach the packaged fiber products 4. Therefore, the bleaching treatment can be efficiently and evenly performed with the use of ozone of a lower concentration. In addition, the treatment is performed in the hermetic vessel serving as the treatment vessel 1 in a completely closed state, so that the working environment can be kept intact without the possibility that undecomposed ozone leaks to the ambient environment. Since the fiber products 4 are bleached in an immobilized packaged state under the relatively gentle conditions, the resulting bleached fiber products each advantageously have a smooth texture and are substantially free from degradation. The bleached fiber products are intentionally yellowed in the midst of the treatment, and then the yellowing substance is decomposed to be removed. Therefore, the bleached fiber products are advantageously free from the over-time yellowing after the treatment, and their whiteness is stably maintained immediately after the production.

Since the bleaching apparatus can be provided simply by modifying the conventional package type treatment apparatus, facility costs are minimized. The bleaching apparatus is capable of safely producing the bleached fiber products each having an excellent texture without the leak of the undecomposed ozone to the ambient environment.

In the apparatus of FIG. 1, the ozone-containing liquid is caused to flow from the inside to the outside of the fiber products 4 each packaged in the cheese form. Alternatively, the ozone-containing liquid may be caused to flow from the outside to the inside of the fiber products 4 by changing the connection of the circulation pump 6 and the ejector 12. Further, the inside-to-outside flow and the outside-to-inside flow may be alternated. In the case of the outside-to-inside flow, however, it is difficult to cause the ozone-containing liquid to evenly flow in the inner portions of the fiber products 4. Therefore, it is basically desirable to cause the ozone-containing liquid to flow from the inside to the outside of the fiber products 4.

In the embodiment described above, the fiber products 4 are first wetted by circulating only the ordinary temperature water in order to uniformly bleach even inner portions of fibers when the ozone bleaching step is subsequently performed by circulating the ozone-containing liquid. In the embodiment described above, the ordinary temperature water is circulated for 10 minutes, and then citric acid is injected into the ordinary temperature water, which is in turn further circulated for 10 minutes. Alternatively, acidic ordinary temperature water into which citric acid is injected may be initially applied to the fiber products 4 to wet the fiber products 4.

Typical examples of the ordinary temperature water to be used for the wetting include distilled water, pure water and ion-exchanged water. Instead of the 100% water, water containing a proper additive such as a chelate agent may be used. The temperature of the water is such that the water is neither heated nor cooled, and is typically in the range of 20° C. to 35° C. depending upon an ambient temperature. Particularly, the ordinary temperature water is later mixed with the ozone gas to provide the ozone-containing liquid to be circulated. Therefore, it is not preferred that the water temperature is 40° C. or higher at which the ozone is decomposed.

The amount of the ordinary temperature water is not particularly limited, as long as the fiber products 4 are sufficiently wetted. Provided that the ozone gas is mixed with the ordinary temperature water and the resulting mixture is circulated for the ozone bleaching, the bath ratio is preferably 1:5 to 1:15, particularly preferably 1:8 to 1:13. A period for wetting the fiber products 4 with the ordinary temperature water is not limited to the aforementioned period, but may be properly determined depending upon the form of the fiber products 4 and the bath ratio. The amount of the liquid to be circulated is not particularly limited, but is preferably the same as the amount of the liquid to be circulated in the subsequent ozone bleaching step without the need for changing the setting of the circulation pump 6 for each step.

The citric acid injected into the ordinary temperature water acidifies the liquid for prevention of the decomposition of the ozone when the ozone-containing liquid is prepared for the ozone bleaching by mixing the ozone gas with the liquid. In this case, the acid to be injected is not limited to the citric acid, but may be other proper acid. The liquid is preferably acidic with a pH of about 3 to about 6. If the liquid is too acidic, the fiber products 4 are liable to be adversely affected. If the liquid is neutral to alkaline, the ozone is liable to be decomposed, failing to provide the bleaching effect.

In the embodiment described above, the ozone gas is injected into the circulated ordinary temperature water via the ejector 12, and the amount of the ozone to be injected is preferably such that the ozone-containing liquid resulting from the injection has an ozone concentration of 10 to 300 g/Nm$^3$, particularly 50 to 150 g/Nm$^3$. If the ozone concentration is less than 10 g/Nm$^3$, the bleaching is liable to be insufficient. If the ozone concentration is higher than 300 g/Nm$^3$, conversely, the strength of the fiber products 4 is liable to be reduced.

In the embodiment described above, the ozone gas is mixed in the form of minute bubbles with the ordinary temperature water by the ejector 12. This is because the use of the treatment liquid in which the minute bubbles of the ozone gas are dispersed ensures that the bleaching treatment can be evenly performed to provide the fiber products 4 each having an excellent texture. For generation of the minute bubbles, a pressure is reduced, for example, to ⅔ to ⅕ when the ozone and the liquid are ejected from the ejector 12. Thus, a pressure difference is produced between the internal pressure of the ejector 12 and a pressure observed immediately after the ejection, whereby the ozone gas is disintegrated into the minute bubbles which are dispersed in the liquid. The gas-liquid mixing/ejecting means is not limited to the ejector 12, but a vortex pump or a mixing pump may be used.

The flow rate for the forcible circulation of the ozone-containing liquid depends upon the material for and the form of the fiber products, but is typically 15 to 90 liters/min per 1 kg of the fiber products. If the flow rate for the circulation is too low, the ozone-containing liquid cannot easily flow into the inner portions of the packaged fiber products 4 and, therefore, the treatment is time-consuming. If the flow rate for the circulation is too high, conversely, there is a possibility that the fiber products 4 are damaged.

The temperature of the ozone-containing liquid is preferably an ordinary temperature, and a period for the forcible circulation is typically 15 to 60 minutes, particularly preferably 20 to 40 minutes. If the treatment period is shorter than 15 minutes, the bleaching treatment is insufficient. Even if the treatment period is longer than 60 minutes, it is impossible to provide an additional effect, yet requiring higher energy costs.

In the embodiment described above, the circulated hot water has a liquid temperature of 80° C. in the yellowing step subsequent to the bleaching step. The hot water promotes the yellowing reaction caused by the ozone and, if the liquid temperature is lower than 50° C., the promoting effect is insufficient, failing to cause the yellowing in a short period of time. Therefore, the liquid temperature is desirably not lower than 50° C. Particularly, the liquid temperature for the yellowing is preferably 80° C. to 100° C. The amount of the hot water is preferably such that the bath ratio is in the range of 1:5 to 1:15, particularly 1:8 to 1:13. Like the ordinary temperature water, the hot water is not necessarily required to be 100% water, but a proper additive may be added.

A treatment period required for the yellowing is preferably 1 to 30 minutes, particularly preferably not longer than 15 minutes. If the treatment period is too short, the intentional yellowing is insufficient, so that the produced bleached fiber products are liable to suffer from the over-time yellowing. If the treatment period is too long, conversely, there is no difference in yellowing preventing effect, but the fiber strength is disadvantageously reduced due to the powerful influence of the ozone. Further, the energy costs required for the preparation of the hot water are disadvantageously increased.

On the other hand, the chemical agent liquid to be used for the treatment in the ozone decomposing step subsequent to the bleaching step is not limited to the aforementioned one, but the following recipe (A) is advantageously employed.

| Recipe (A) | |
|---|---|
| Bath ratio | 1:8 to 1:13 |
| Treatment temperature | 60° C. to 90° C. |
| Treatment period | 10 to 20 minutes |
| Hydrogen peroxide | 1 to 6 g/liter |
| Sodium hydroxide | 1 to 4 g/liter |
| Surface active agent | 0.5 to 2 g/liter |
| Stabilizer | 0.5 to 2 g/liter |

Sodium hydroxide is used to alkalify the liquid (preferably at pH 8 to pH 10), and any of various alkali agents such as potassium hydroxide, sodium sulfate, potassium sulfate, sodium silicate and potassium silicate may be used instead of the sodium hydroxide or together with the sodium hydroxide.

A preferred example of the surface active agent is SUNMORL (available from Nicca Chemical Co., Ltd.) and a preferred example of the stabilizer is BRIGHT NIK (available from Rakuto Kasei Industrial Co., Ltd.)

Figure 5:
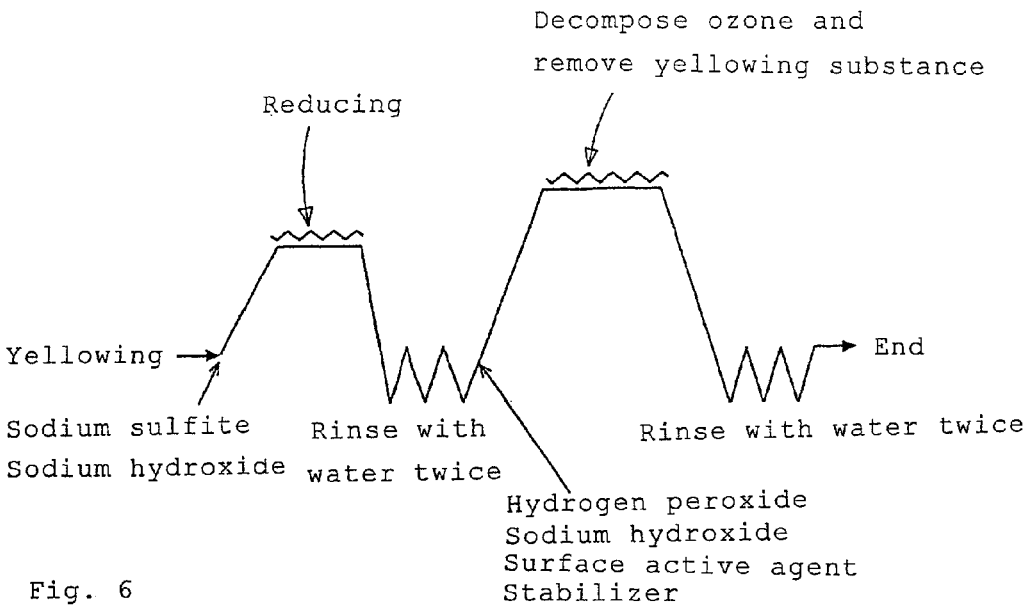
FIG. 5 is a process diagram showing some steps according to another embodiment of the present invention.

Another exemplary method for the decomposition of the ozone is a two-step method such that, as shown in FIG. 5, a reducing step is first performed by supplying a first chemical agent liquid mainly containing sodium nitrite and sodium hydroxide into the treatment vessel 1 and forcibly circulating the first chemical agent liquid to nullify the oxidation power of the residual ozone by the reducing agent as in the embodiment described above, then a water rinsing operation is repeated twice, and the ozone decomposing step is performed with the use of a second chemical agent liquid mainly containing hydrogen peroxide and sodium hydroxide as in the embodiment describe above. This method is advantageous in that the fiber products are unlikely to be damaged though the bleached fiber products each have a lower whiteness.

The following recipe (B) is preferably employed for the first chemical agent liquid in the reducing step.

| Recipe (B) | |
|---|---|
| Bath ratio | 1:8 to 1:13 |
| Treatment temperature | 30° C. to 80° C. |
| Treatment period | 10 to 20 minutes |

-continued

| Recipe (B) | |
|---|---|
| Sodium sulfite | 2 to 4 g/liter |
| Sodium hydroxide | 1 to 2 g/liter |

The sodium sulfite serves as the reducing agent, and a reducing agent such as hydrosulfite or sodium thiosulfate may be used instead of the sodium sulfite or together with the sodium sulfite.

Figure 6:
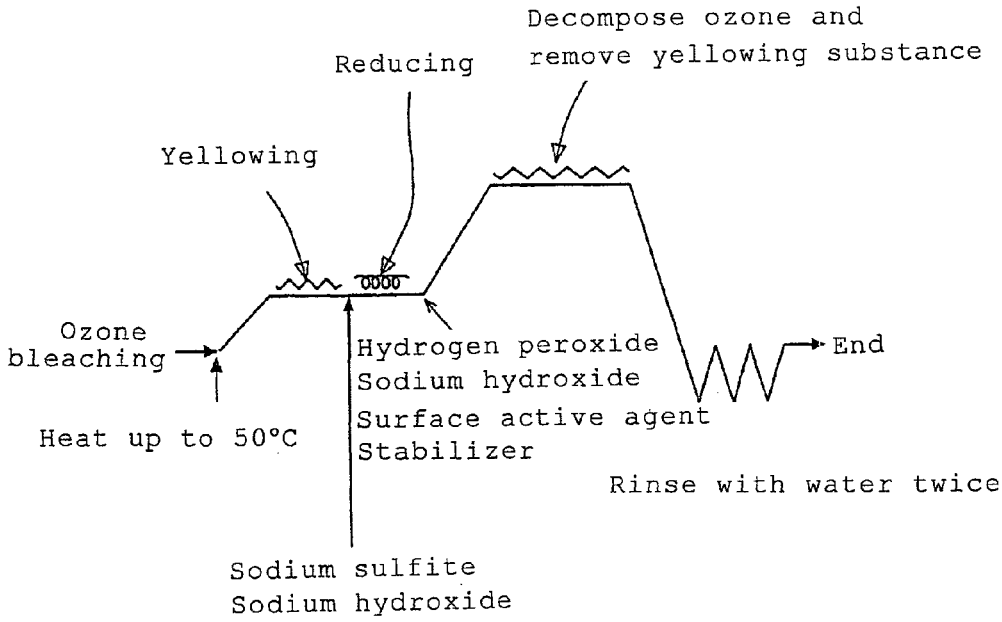
FIG. 6 is a process diagram showing some steps according to further another embodiment of the present invention.

Further another method is such that, as shown in FIG. 6, the ozone bleaching step, the yellowing step, the reducing step using the first chemical agent liquid and the ozone decomposing step using the second chemical agent liquid are sequentially performed in the single vessel without the drainage and the water rinsing. This method is highly feasible though the bleached fiber products each have a lower whiteness. In addition, the amounts of the treatment liquids to be used are significantly reduced, whereby costs for water and energy are drastically reduced.

In the method in which the steps are sequentially performed in the single vessel, the yellowing step is preferably performed by heating the treatment liquid resulting from the ozone bleaching step at 50° C. If the temperature is higher than 50° C., the subsequent reducing step is less effective, so that the removal of the yellowing substance is insufficient.

In the embodiment described above, the waste liquid and the waste gas discharged from the treatment vessel 1 after the bleaching step is introduced into the alkali waste liquid tank 23, in which the ozone is decomposed by the alkali waste liquid. Further, the ozone-containing gas present above the liquid surface of the alkali waste liquid is transferred into the boiler chimney in which the ozone is thermally decomposed. However, the ozone is optionally detoxified in this manner. In some plants, the alkali waste liquid tank 23 and the boiler chimney are not located in the vicinity of the treatment vessel. In this case, it is desirable to separately provide an additional alkali treatment tank or other ozone decomposing means. However, the use of the alkali waste liquid tank 23 and the boiler chimney is preferred without the need for additional treatment costs.

In the embodiment described above, the treatment liquid is drained from the treatment vessel 1, and the water rinsing operation is repeated twice between the bleaching step and the yellowing step and between the yellowing step and the ozone decomposing step. Whether the water rinsing operation is performed or not is properly determined depending upon an object to be treated and a required fiber whiteness level.

In the embodiment described above, the vertical treatment vessel is used as the treatment vessel 1, but a horizontal treatment vessel may be used as the treatment vessel 1. The method of loading the fiber products 4 into the treatment vessel 1 and the form of the fiber products 4 to be loaded are not limited to those described above, but may be properly determined.

In the inventive bleaching apparatus, the inner surface of the treatment vessel 1 and the inner surfaces of the respective pipes through which the ozone-containing gas flows are preferably coated with a fluorine-containing resin such as TEFLON® available from E.I. Du Pont de Nemours and Company for prevention of corrosion occurring due to ozone oxidation. Further, joints of the respective components are preferably each sealed with a mechanical seal having a liquid contact portion coated with a fluorine-containing resin.

In the inventive bleaching apparatus, the number, the positions and the settings of the ozone sensors for maintaining the ozone concentration at the constant level are not limited to those described above, but may be properly determined. However, the embodiment described above is advantageous in that the concentration can be highly accurately controlled based on not only the ozone concentration of the ozone-containing liquid in the treatment vessel 1 but also the plurality of corrected measurement values.

Figure 7:
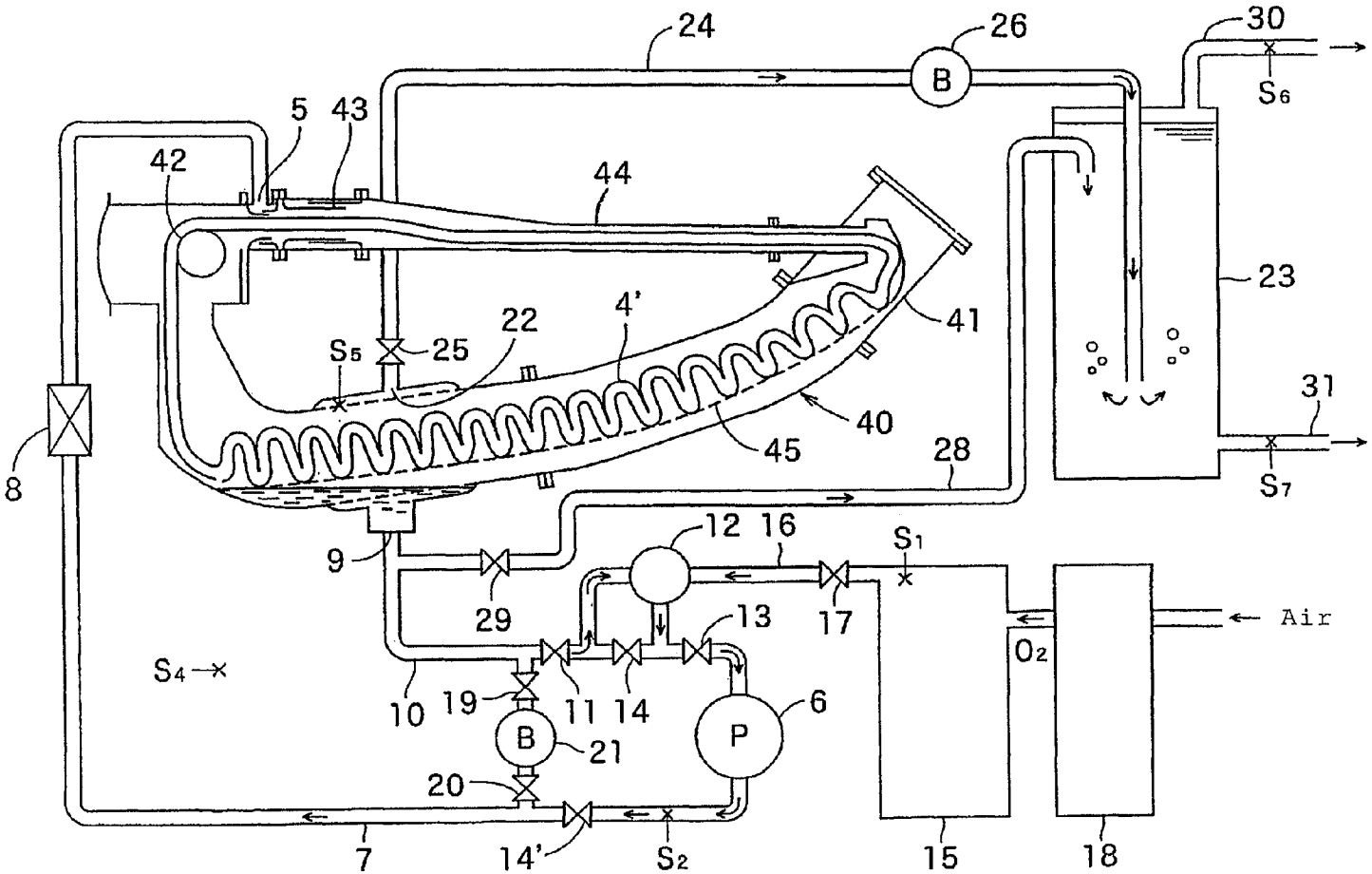
FIG. 7 is a structural diagram of a bleaching apparatus to be used in still another embodiment of the present invention.

The preceding description is directed to a case in which the present invention is applied to the package type treatment apparatus, but the invention is applicable to any of various types of treatment apparatuses which are adapted to perform a treatment by forcibly circulating the treatment liquid from the inside to the outside of the treatment vessel. For example, as shown in FIG. 7, the present invention is applicable to a liquid flow type treatment apparatus including a liquid flow type treatment vessel 40 instead of the package type treatment vessel 1.

The treatment vessel 40 of the liquid flow type treatment apparatus may be any type of liquid flow type treatment vessel, as long as a fiber product 4' such as a fabric is transported in a rope form in a liquid stream. In this embodiment, the treatment vessel 40 includes a retention vessel 41 in which the fiber product 4' is retained in a meandering state and transported, and a transport passage 44 through which the fiber product 4' pulled up by a reel 42 is transported in a stream of a liquid jetted from a liquid jetting portion 43. A reference numeral 45 denotes a perforated separation plate for separating the fiber product 4' from a treatment liquid in the retention vessel 41. The treatment liquid remaining in the bottom of the retention vessel 41 is circulated through a circulation pump 6 and a heat exchanger 8 to be supplied into the liquid jetting portion 43. The apparatus has substantially the same construction as that shown in FIG. 1 except for the aforementioned members. Therefore, like components will be denoted by like reference characters, and duplicate explanation will be omitted.

In this apparatus, the treatment liquid is forcibly circulated in contact with the fiber product 4' to treat the fiber product 4' as in the package type treatment apparatus. The ozone bleaching treatment is performed in the same manner as in the embodiment described above.

Where the liquid flow type treatment apparatus is used, the ozone-containing liquid to be used for the ozone bleaching preferably has a concentration of 10 to 300 g/Nm$^3$, particularly preferably 100 to 200 g/Nm$^3$, and the bath ratio is preferably 1:5 to 1:20.

Where the aforementioned package type treatment apparatus is used, the fiber products 4 are each tightly packaged and impregnated with the treatment liquid for the treatment. Therefore, the fiber products 4 are unlikely to be brought into contact with air during the treatment, so that the yellowing is less liable to occur due to oxidation with air. For this reason, the yellowing is intentionally caused and, in the ozone decomposing step, the residual ozone and the resulting yellowing substance are simultaneously decomposed. This arrangement is advantageous for prevention of further yellowing. In the liquid flow type treatment apparatus, however, the rope-form fiber product 4' is often brought into contact with air during the transport, so that the yellowing occurs to some extent without the intentional yellowing step prior to the ozone decomposing step. Therefore, the intentional yellowing step as performed in the embodiment described above is not necessarily required, but further yellowing can be prevented to some extent by removing a naturally occurring yellowing substance in the ozone decomposing step. Of course, the intentional yellowing step provides a more perfect yellowing preventing effect.

For the prevention of the further yellowing, it is preferred that the first reducing chemical agent liquid mainly containing sodium nitrite and sodium hydroxide according to the above recipe (B) and the second chemical agent liquid mainly containing hydrogen peroxide and sodium hydroxide according to the above recipe (A), for example, are used for an ozone decomposing chemical agent liquid effective for the removal of the naturally occurring yellowing substance.

Figure 8:
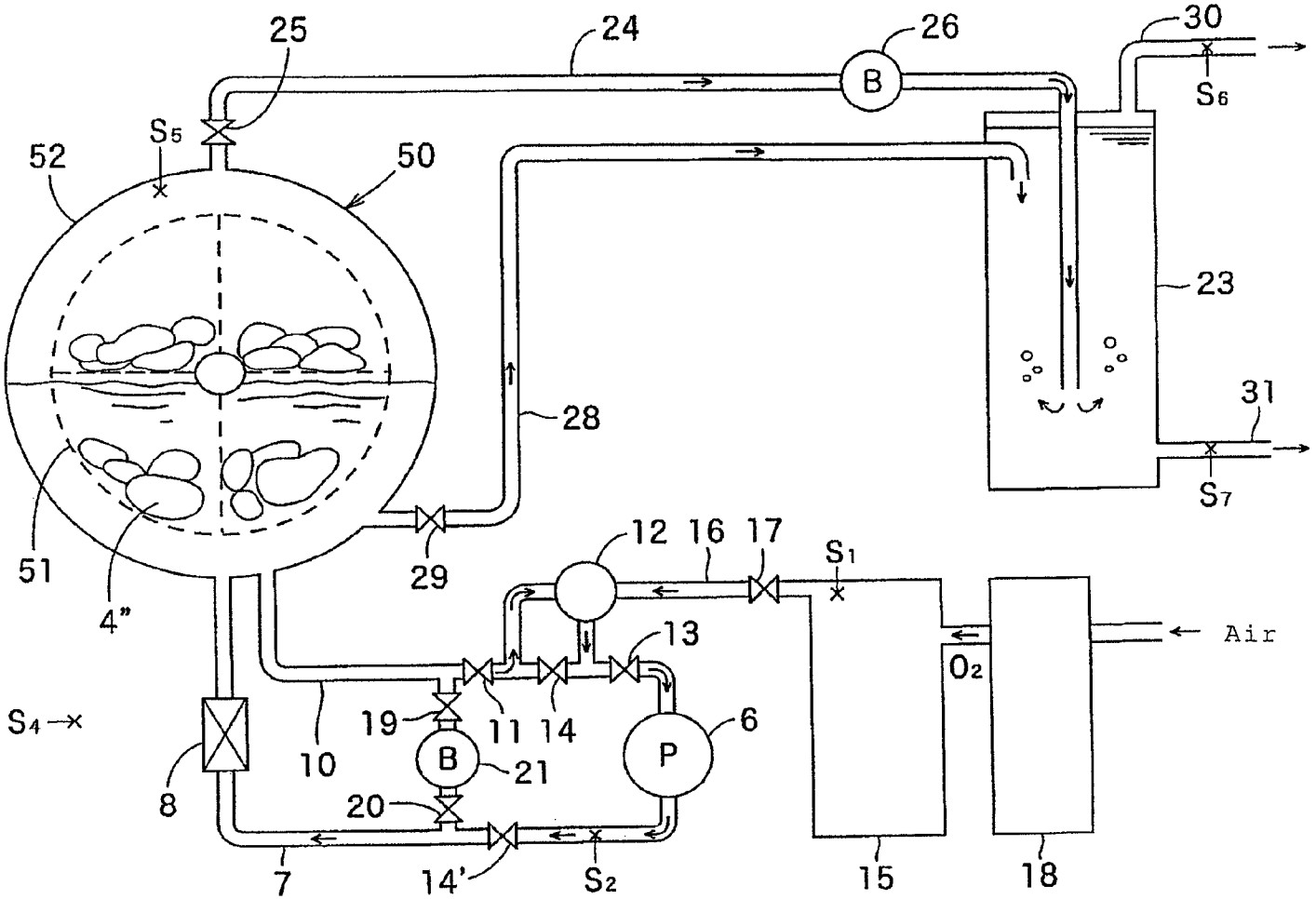
FIG. 8 is a structural diagram of a bleaching apparatus to be used in further another embodiment of the present invention.

Further, the present invention is applicable, for example, to a rotary drum type treatment apparatus including a washer type treatment vessel 50 as shown in FIG. 8.

The washer type treatment vessel 50 is configured so that fiber products 4" such as woven fabrics and knitted fabrics are loaded in a perforated rotary drum 51 and treated in contact with a treatment liquid retained in an outer tub 52 while the rotary drum 51 is rotated. Any type of rotary drum type treatment vessel may be employed. The treatment liquid retained in the outer tub 52 is circulated through the circulation pump 6 and the heat exchanger 8 and then fed back into the outer tub 52. The treatment apparatus has substantially the same construction as that shown in FIG. 1 except for the aforementioned members. Therefore, like components will be denoted by like reference characters, and duplicate explanation will be omitted.

In this apparatus, the treatment liquid is forcibly circulated in contact with the fiber products 4" to treat the fiber products 4" as in the package type treatment apparatus and the liquid flow type treatment apparatus. The ozone bleaching treatment is performed in the same manner as in the embodiments described above.

Where the rotary drum type treatment apparatus is used, the ozone-containing liquid to be used in the ozone bleaching step preferably has a concentration of 10 to 300 g/Nm$^3$, particularly preferably 100 to 200 g/Nm$^3$, and the bath ratio is preferably 1:8 to 1:30.

In the rotary drum treatment apparatus, the fiber products 4" are often brought into contact with air in the rotary drum 51, as in the liquid flow treatment apparatus, when the fiber products are moved by the rotation of the rotary drum 51. Therefore, the yellowing occurs to some extent without the intentional yellowing step prior to the ozone decomposing step. Therefore, the intentional yellowing step as performed in the embodiment described above is not necessarily required, but further yellowing can be prevented to some extent by removing a naturally occurring yellowing substance in the ozone decomposing step. Of course, the intentional yellowing step provides a more perfect yellowing preventing effect.

As in the case of the liquid flow type treatment apparatus, the first reducing chemical agent liquid and the second chemical agent liquid are preferably employed in combination for an ozone decomposing chemical agent liquid effective for the removal of the naturally occurring yellowing substance.

EXAMPLES

Inventive examples will be described in conjunction with comparative examples. However, the present invention is not limited to the following examples.

Examples 1 to 8 and Comparative Example 1

Fiber products (single yarns) were subjected to the ozone bleaching treatment under the following treatment conditions (with the use of the apparatus having a basic construction as shown in FIG. 1) according to recipes shown in Tables 1 and 2, and taken out of the treatment vessel and dried. Thus, bleached fiber products were provided. The whiteness and the fiber strength of each of the bleached fiber products were respectively determined in conformity with JIS-1991 and JIS-L-1095. Further, the bleaching uniformity and the texture of each of the bleached fiber products were evaluated in the following manner. The results and the comprehensive evaluation are shown in Tables 1 and 2.

Treatment Conditions (1) Treatment Vessel 70-liter type Over-Myer (produced by Hisaka Works, Ltd.)

(2) Bath Ratio

1:10

(3) Object to be Treated

Seven 1-kg cheeses of cotton yarns each having a yarn count number of 20 were loaded in the treatment vessel.

(4) Water Used

Ion-exchanged water (25° C.)

(5) Liquid Circulation Rate 300 liters/minute

Bleaching Uniformity

For each of the inventive examples and the comparative example, ten knit fabrics (50 cm×50 cm square) were produced from yarns taken from cheeses located at different positions in the treatment vessel, and visually checked for variation in whiteness by ten examiners. Based on majority rule, the bleaching uniformity was rated on a scale of the following four levels: excellent (◎); good (○); no good (Δ); and bad (x).

Texture

The knit fabrics was touched and organoleptically evaluated for their texture by ten examiners. Based on majority rule, the texture was rated on a scale of the following four levels: very smooth (◎); smooth (○); moderate (Δ); and bad (x).

TABLE 1

| | Example | | | | Comparative Example |
|---|---|---|---|---|---|
| | 1 | 2 | 3 | 4 | 1 |
| Wetting step | | | | | |
| Treatment liquid temperature (° C.) | 25 | 25 | 25 | 25 | 25 |
| Treatment period (min) | 10 | 10 | 10 | 10 | 10 |
| Ozone bleaching step | | | | | |
| Ozone concentration (g/Nm$^3$) | 20 | 50 | 100 | 150 | 100 |
| Treatment liquid temperature (° C.) | 25 | 25 | 25 | 25 | 25 |
| Treatment period (min) | 30 | 30 | 30 | 30 | 30 |
| Citric acid (g/L) | 1 | 1 | 1 | 1 | 1 |
| Yellowing step | | | | | |
| Treatment liquid temperature (° C.) | 80 | 80 | 80 | 80 | — |
| Treatment period (min) | 10 | 10 | 10 | 10 | — |
| Ozone decomposing step | | | | | |
| Reducing | | | | | |
| Sodium sulfite (g/L) | — | — | — | — | — |
| NaOH (g/L) | — | — | — | — | — |
| Treatment liquid temperature (° C.) | — | — | — | — | — |
| Treatment period (min) | — | — | — | — | — |

TABLE 1-continued

| | Example | | | | Comparative Example |
|---|---|---|---|---|---|
| | 1 | 2 | 3 | 4 | 1 |
| Hydrogen peroxide treatment | | | | | |
| Hydrogen peroxide (g/L) | 3 | 3 | 3 | 3 | — |
| NaOH (g/L) | 3 | 3 | 3 | 3 | — |
| Surface active agent (g/L) | 1 | 1 | 1 | 1 | — |
| Stabilizer (g/L) | 1 | 1 | 1 | 1 | — |
| Treatment liquid temperature (° C.) | 90 | 90 | 90 | 90 | — |
| Treatment period (min) | 15 | 15 | 15 | 15 | — |
| Evaluation | | | | | |
| Whiteness (JIS-1991) | 66 | 72 | 77 | 79 | 51 |
| Fiber strength (JIS-L-1095) (cN) | 500 | 480 | 450 | 390 | 440 |
| Bleaching uniformity | ◎ | ◎ | ◎ | ◎ | X |
| Texture | ◎ | ◎ | ◎ | ◎ | Δ |
| Comprehensive evaluation | Δ | ○ | ◎ | Δ | X |

TABLE 2

| | Example | | | |
|---|---|---|---|---|
| | 5 | 6 | 7 | 8 |
| Wetting step | | | | |
| Treatment liquid temperature (° C.) | 25 | 25 | 25 | 25 |
| Treatment period (min) | 10 | 10 | 10 | 10 |
| Ozone bleaching step | | | | |
| Ozone concentration (g/Nm$^3$) | 75 | 75 | 75 | 75 |
| Treatment liquid temperature (° C.) | 25 | 25 | 25 | 25 |
| Treatment period (min) | 25 | 30 | 40 | 60 |
| Citric acid (g/L) | 1 | 1 | 1 | 1 |
| Yellowing step | | | | |
| Treatment liquid temperature (° C.) | 80 | 80 | 80 | 80 |
| Treatment period (min) | 10 | 10 | 10 | 10 |
| Ozone decomposing step | | | | |
| Reducing | | | | |
| Sodium sulfite (g/L) | 2 | 2 | 2 | 2 |
| NaOH (g/L) | 1 | 1 | 1 | 1 |
| Treatment liquid temperature (° C.) | 30 | 30 | 30 | 30 |
| Treatment period (min) | 10 | 10 | 10 | 10 |
| Hydrogen peroxide treatment | | | | |
| Hydrogen peroxide (g/L) | 3 | 3 | 3 | 3 |
| NaOH (g/L) | 3 | 3 | 3 | 3 |
| Surface active agent (g/L) | 1 | 1 | 1 | 1 |
| Stabilizer (g/L) | 1 | 1 | 1 | 1 |
| Treatment liquid temperature (° C.) | 90 | 90 | 90 | 90 |
| Treatment period (min) | 15 | 15 | 15 | 15 |
| Evaluation | | | | |
| Whiteness (JIS-1991) | 68 | 74 | 77 | 79 |
| Fiber strength (JIS-L-1095) (cN) | 500 | 490 | 450 | 390 |
| Bleaching uniformity | ◎ | ◎ | ◎ | ◎ |
| Texture | ◎ | ◎ | ◎ | ◎ |
| Comprehensive evaluation | Δ | ◎ | ◎ | Δ |

Example 9

A bleached fiber product was produced in substantially the same manner as in Example 1, except that the steps shown in FIG. 6 were sequentially performed in a single treatment vessel according to a recipe shown in Table 3.

Example 10

Basically, the treatment was performed in substantially the same manner as in Example 6, except that the ozone gas to be mixed with the treatment liquid was allowed to have a greater bubble size than in Example 6 by adjusting the settings of the ejector. That is, the ozone-containing liquid in which the ozone gas was mixed in a minute bubble form was turbid with minute bubbles in Example 6. In this example, the ozone-containing liquid was such that bubbles each having a diameter of 1 to 2 mm were seen therein.

Example 11

Basically, the treatment was performed in substantially the same manner as in Example 6, except that the ozone gas to be mixed with the treatment liquid was allowed to have a smaller bubble size than in Example 6 by adjusting the settings of the ejector. That is, the bubble size was further reduced by increasing the pressure reduction ratio as compared with Example 6, although it was not confirmed by the naked eyes that the minute bubbles of the ozone gas each had a smaller bubble size than in Example 6.

Products thus produced were evaluated in the same manner as described above. The results and the recipes are shown in Table 3.

TABLE 3

| | Example | | |
|---|---|---|---|
| | 9 | 10 | 11 |
| Wetting step | | | |
| Treatment liquid temperature (° C.) | 25 | 25 | 25 |
| Treatment period (min) | 10 | 10 | 10 |
| Ozone bleaching step | | | |
| Ozone concentration (g/Nm$^3$) | 100 | 75 | 75 |
| Treatment liquid temperature (° C.) | 25 | 25 | 25 |
| Treatment period (min) | 30 | 30 | 30 |
| Citric acid (g/L) | 1 | 1 | 1 |
| Yellowing step | | | |
| Treatment liquid temperature (° C.) | 50 | 80 | 80 |
| Treatment period (min) | 10 | 10 | 10 |
| Ozone decomposing step | | | |
| Reducing | | | |
| Sodium sulfite (g/L) | 2 | 2 | 2 |
| NaOH (g/L) | 1 | 1 | 1 |
| Treatment liquid temperature (° C.) | 50 | 30 | 30 |
| Treatment period (min) | 10 | 10 | 10 |
| Hydrogen peroxide treatment | | | |
| Hydrogen peroxide (g/L) | 3 | 3 | 3 |
| NaOH (g/L) | 3 | 3 | 3 |
| Surface active agent (g/L) | 1 | 1 | 1 |
| Stabilizer (g/L) | 1 | 1 | 1 |
| Treatment liquid temperature (° C.) | 90 | 90 | 90 |
| Treatment period (min) | 20 | 15 | 15 |
| Evaluation | | | |
| Whiteness (JIS-1991) | 70 | 75 | 72 |
| Fiber strength (JIS-L-1095) (cN) | 450 | 440 | 450 |
| Bleaching uniformity | ◎ | ◎ | ◎ |
| Texture | ◎ | ◎ | ◎ |
| Comprehensive evaluation | ○ | ◎ | ◎ |

The above results indicate that the fabrics of Examples 1 to 11 were generally excellent.

Next, fabrics treated and dried in Examples 6 and 7 and Comparative Example 1 were allowed to naturally stand in a room without temperature control for evaluation of the over-time yellowing. The whiteness levels of the fabrics were measured in conformity with JIS-1991 after a lapse of 1 day, 30 days and 60 days. Further, the whiteness levels of the fabrics were measured in the same manner as described above after a forced dry heating process was performed at 150° C. for 10 minutes. The results are shown in Table 4.

TABLE 4

| | Example | | Comparative Example |
|---|---|---|---|
| | 6 | 7 | 1 |
| Whiteness (JIS-1991) After natural standing in room | | | |
| 1 day | 74 | 77 | 51 |
| 30 days | 73 | 74 | 48 |
| 60 days | 72 | 72 | 42 |
| After forced heating | 72 | 72 | 45 |
| Evaluation | ◎ | ◎ | X |

The above results indicate that the fabrics of Examples 6 and 7 were substantially free from the over-time yellowing and maintained their whiteness. However, the fabric of Comparative Example 1 subjected to neither the intentional yellowing step nor the ozone decomposing step suffered from significant over-time yellowing, and was not suitable for practical use.

Examples 12 to 21 and Comparative Example 2

Fiber products (cotton woven fabrics) were subjected to an ozone bleaching treatment under the following treatment conditions (with the use of the apparatus having a basic construction as shown in FIG. 7) according to recipes shown in Tables 5 to 7, and taken out of the treatment vessel and dried. Thus, bleached fiber products were provided. The whiteness of each of the bleached fiber products was determined in conformity with JIS-1991. Further, the bleaching uniformity and the texture of each of the bleached fiber products were evaluated in the following manner. The results and the comprehensive evaluation are shown in Tables 5 to 7.

Treatment Conditions (1) Treatment Vessel 50-kg type circulator (produced by Hisaka Works, Ltd.)

(2) Bath Ratio

1:10

(3) Object to be Treated 50 kg cotton woven fabrics (4) Water Used

Ion-exchanged water (25° C.)

(5) Liquid Circulation Rate 1000 liters/minute

Bleaching Uniformity

For each of the inventive examples and the comparative example, ten fabric samples (50 cm×50 cm square) taken out of the treatment vessel were visually checked for variation in whiteness by ten examiners. Based on majority rule, the bleaching uniformity was rated on a scale of the following four levels: excellent (◎); good (○); no good (Δ); and bad (x).

Texture

The fabric samples were each touched and organoleptically evaluated for their texture by ten examiners. Based on majority rule, the texture was rated on a scale of the following four levels: very smooth (◎); smooth (○); moderate (Δ); and bad (x).

TABLE 5

| | Example | | | |
|---|---|---|---|---|
| | 12 | 13 | 14 | 15 |
| Wetting step | | | | |
| Treatment liquid temperature (° C.) | 25 | 25 | 25 | 25 |
| Treatment period (min) | 10 | 10 | 10 | 10 |
| Ozone bleaching step | | | | |
| Ozone concentration (g/Nm$^3$) | 100 | 150 | 150 | 200 |
| Treatment liquid temperature (° C.) | 25 | 25 | 25 | 25 |
| Treatment period (min) | 40 | 40 | 40 | 40 |
| Citric acid (g/L) | 1 | 1 | 1 | 1 |
| Yellowing step | | | | |
| Treatment liquid temperature (° C.) | 80 | 80 | — | 80 |
| Treatment period (min) | 10 | 10 | — | 10 |
| Ozone decomposing step Reducing | | | | |
| Sodium sulfite (g/L) | 2 | 2 | 2 | 2 |
| NaOH (g/L) | 1 | 1 | 1 | 1 |
| Treatment liquid temperature (° C.) | 30 | 30 | 30 | 30 |
| Treatment period (min) | 10 | 10 | 10 | 10 |
| Hydrogen peroxide treatment | | | | |
| Hydrogen peroxide (g/L) | 3 | 3 | 3 | 3 |
| NaOH (g/L) | 3 | 3 | 3 | 3 |
| Surface active agent (g/L) | 1 | 1 | 1 | 1 |
| Stabilizer (g/L) | 1 | 1 | 1 | 1 |
| Treatment liquid temperature (° C.) | 90 | 90 | 90 | 90 |
| Treatment period (min) | 15 | 15 | 15 | 15 |
| Evaluation | | | | |
| Whiteness (JIS-1991) | 70 | 78 | 70 | 79 |
| Fiber strength (JIS-L-1095) (cN) | 1200 | 1100 | 1100 | 800 |
| Bleaching uniformity | ○ | ◎ | ○ | ◎ |
| Texture | ○ | ◎ | ○ | Δ |
| Comprehensive evaluation | ○ | ◎ | ○ | Δ |

TABLE 6

| | Example | | | |
|---|---|---|---|---|
| | 16 | 17 | 18 | 19 |
| Wetting step | | | | |
| Treatment liquid temperature (° C.) | 25 | 25 | 25 | 25 |
| Treatment period (min) | 10 | 10 | 10 | 10 |
| Ozone bleaching step | | | | |
| Ozone concentration (g/Nm$^3$) | 50 | 120 | 120 | 120 |
| Treatment liquid temperature (° C.) | 25 | 25 | 25 | 25 |
| Treatment period (min) | 40 | 20 | 30 | 40 |
| Citric acid (g/L) | 1 | 1 | 1 | 1 |
| Yellowing step | | | | |
| Treatment liquid temperature (° C.) | 80 | 80 | 80 | 80 |
| Treatment period (min) | 10 | 10 | 10 | 10 |
| Ozone decomposing step Reducing | | | | |
| Sodium sulfite (g/L) | 2 | 2 | 2 | 2 |
| NaOH (g/L) | 1 | 1 | 1 | 1 |
| Treatment liquid temperature (° C.) | 30 | 30 | 30 | 30 |
| Treatment period (min) | 10 | 10 | 10 | 10 |
| Hydrogen peroxide treatment | | | | |
| Hydrogen peroxide (g/L) | 3 | 3 | 3 | 3 |
| NaOH (g/L) | 3 | 3 | 3 | 3 |
| Surface active agent (g/L) | 1 | 1 | 1 | 1 |
| Stabilizer (g/L) | 1 | 1 | 1 | 1 |
| Treatment liquid temperature (° C.) | 90 | 90 | 90 | 90 |
| Treatment period (min) | 15 | 15 | 15 | 15 |

TABLE 6-continued

| | Example | | | |
|---|---|---|---|---|
| | 16 | 17 | 18 | 19 |
| Evaluation | | | | |
| Whiteness (JIS-1991) | 64 | 68 | 72 | 74 |
| Fiber strength (JIS-L-1095) (cN) | 1200 | 1200 | 1200 | 1200 |
| Bleaching uniformity | ○ | ○ | ◎ | ◎ |
| Texture | ○ | ○ | ◎ | ◎ |
| Comprehensive evaluation | Δ | Δ | ○ | ◎ |

TABLE 7

| | Example | | Comparative Example |
|---|---|---|---|
| | 20 | 21 | 2 |
| Wetting step | | | |
| Treatment liquid temperature (° C.) | 25 | 25 | 25 |
| Treatment period (min) | 10 | 10 | 10 |
| Ozone bleaching step | | | |
| Ozone concentration (g/Nm$^3$) | 120 | 120 | 75 |
| Treatment liquid temperature (° C.) | 25 | 25 | 25 |
| Treatment period (min) | 60 | 40 | 40 |
| Citric acid (g/L) | 1 | 1 | 1 |
| Yellowing step | | | |
| Treatment liquid temperature (° C.) | 80 | — | — |
| Treatment period (min) | 10 | — | — |
| Ozone decomposing step Reducing | | | |
| Sodium sulfite (g/L) | 2 | — | — |
| NaOH (g/L) | 1 | — | — |
| Treatment liquid temperature (° C.) | 30 | — | — |
| Treatment period (min) | 10 | — | — |
| Hydrogen peroxide treatment | | | |
| Hydrogen peroxide (g/L) | 3 | 3 | — |
| NaOH (g/L) | 3 | 3 | — |
| Surface active agent (g/L) | 1 | 1 | — |
| Stabilizer (g/L) | 1 | 1 | — |
| Treatment liquid temperature (° C.) | 90 | 90 | — |
| Treatment period (min) | 15 | 15 | — |
| Evaluation | | | |
| Whiteness (JIS-1991) | 76 | 66 | 56 |
| Fiber strength (JIS-L-1095) (cN) | 1100 | 1200 | 1000 |
| Bleaching uniformity | ◎ | ○ | X |
| Texture | ◎ | ○ | X |
| Comprehensive evaluation | ◎ | Δ | X |

The above results indicate that the fabrics of Examples 12 to 21 were generally excellent. However, the fabric of Comparative Example 2 was inferior to the fabrics of Examples 12 to 21 with some evaluation items being practically disadvantageous.

Next, fabrics treated and dried in Examples 13, 14 and 21 and Comparative Example 2 were allowed to naturally stand in a room without temperature control for evaluation of the over-time yellowing. The whiteness levels of the fabrics were measured in conformity with JIS-1991 after a lapse of 1 day, 30 days and 60 days. Further, the whiteness levels of the fabrics were measured in the same manner as described above after a forced dry heating process was performed at 150° C. for 10 minutes. The results are shown in Table 8.

TABLE 8

| | Example | | | Comparative Example |
|---|---|---|---|---|
| | 13 | 14 | 21 | 2 |
| Whiteness (JIS-1991) After natural standing in room | | | | |
| 1 day | 78 | 70 | 66 | 56 |
| 30 days | 76 | 68 | 64 | 54 |
| 60 days | 72 | 67 | 62 | 52 |
| After forced heating | 74 | 68 | 63 | 54 |
| Evaluation | ◎ | ○ | Δ | X |

The above results indicate that the fabrics of Examples 13 and 14 were substantially free from the over-time yellowing and maintained their whiteness. However, the fabric of Example 21 not subjected to the intentional yellowing step and the reducing step of the ozone decomposing step suffered from yellowing to some extent. Further, the fabric of Comparative Example 2 subjected neither the intentional yellowing step nor the ozone decomposing step suffered from significant over-time yellowing, and was not suitable for practical use.

Examples 22 to 31 and Comparative Example 3

Fiber products (cotton woven, fabrics) were subjected to an ozone bleaching treatment under the following treatment conditions (with the use of the apparatus having a basic construction as shown in FIG. 8) according to recipes shown in Tables 9 to 11, and taken out of the treatment vessel and dried. Thus, bleached fiber products were provided. The whiteness of each of the bleached fiber products was determined in conformity with JIS-1991. Further, the bleaching uniformity and the texture of each of the bleached fiber products were evaluated in the following manner. The results and the comprehensive evaluation are shown in Tables 9 to 11.

Treatment Conditions (1) Treatment Vessel 30-kg type washer (produced by Hisaka Works, Ltd.)

(2) Bath Ratio

1:10

(3) Object to be Treated 30 kg cotton woven fabrics (4) Water Used

Ion-exchanged water (25° C.)

(5) Liquid Circulation Rate 450 liters/minute

Bleaching Uniformity

For each of the inventive examples and the comparative example, ten fabric samples (50 cm×50 cm square) taken out of the treatment vessel were visually checked for variation in whiteness by ten examiners. Based on majority rule, the bleaching uniformity was rated on a scale of the following four levels: excellent (◎); good (○); no good (Δ); and bad (x).

Texture

The fabric samples were each touched and organoleptically evaluated for their texture by ten examiners. Based on majority rule, the texture was rated on a scale of the following four levels: very smooth (◎); smooth (○); moderate (Δ); and bad (x).

TABLE 9

| | Example | | | |
|---|---|---|---|---|
| | 22 | 23 | 24 | 25 |
| Wetting step | | | | |
| Treatment liquid temperature (° C.) | 25 | 25 | 25 | 25 |
| Treatment period (min) | 10 | 10 | 10 | 10 |
| Ozone bleaching step | | | | |
| Ozone concentration (g/Nm$^3$) | 100 | 150 | 150 | 200 |
| Treatment liquid temperature (° C.) | 25 | 25 | 25 | 25 |
| Treatment period (min) | 40 | 40 | 40 | 40 |
| Citric acid (g/L) | 1 | 1 | 1 | 1 |
| Yellowing step | | | | |
| Treatment liquid temperature (° C.) | 80 | 80 | — | 80 |
| Treatment period (min) | 10 | 10 | — | 10 |
| Ozone decomposing step | | | | |
| Reducing | | | | |
| Sodium sulfite (g/L) | 2 | 2 | 2 | 2 |
| NaOH (g/L) | 1 | 1 | 1 | 1 |
| Treatment liquid temperature (° C.) | 30 | 30 | 30 | 30 |
| Treatment period (min) | 10 | 10 | 10 | 10 |
| Hydrogen peroxide treatment | | | | |
| Hydrogen peroxide (g/L) | 3 | 3 | 3 | 3 |
| NaOH (g/L) | 3 | 3 | 3 | 3 |
| Surface active agent (g/L) | 1 | 1 | 1 | 1 |
| Stabilizer (g/L) | 1 | 1 | 1 | 1 |
| Treatment liquid temperature (° C.) | 90 | 90 | 90 | 90 |
| Treatment period (min) | 15 | 15 | 15 | 15 |
| Evaluation | | | | |
| Whiteness (JIS-1991) | 68 | 77 | 71 | 79 |
| Fiber strength (JIS-L-1095) (cN) | 1200 | 1100 | 1100 | 800 |
| Bleaching uniformity | ○ | ◎ | ○ | ◎ |
| Texture | ○ | ◎ | ○ | Δ |
| Comprehensive evaluation | ○ | ○ | ○ | Δ |

TABLE 10

| | Example | | | |
|---|---|---|---|---|
| | 26 | 27 | 28 | 29 |
| Wetting step | | | | |
| Treatment liquid temperature (° C.) | 25 | 25 | 25 | 25 |
| Treatment period (min) | 10 | 10 | 10 | 10 |
| Ozone bleaching step | | | | |
| Ozone concentration (g/Nm$^3$) | 50 | 120 | 120 | 120 |
| Treatment liquid temperature (° C.) | 25 | 25 | 25 | 25 |
| Treatment period (min) | 40 | 20 | 30 | 40 |
| Citric acid (g/L) | 1 | 1 | 1 | 1 |
| Yellowing step | | | | |
| Treatment liquid temperature (° C.) | 80 | 80 | 80 | 80 |
| Treatment period (min) | 10 | 10 | 10 | 10 |
| Ozone decomposing step | | | | |
| Reducing | | | | |
| Sodium sulfite (g/L) | 2 | 2 | 2 | 2 |
| NaOH (g/L) | 1 | 1 | 1 | 1 |
| Treatment liquid temperature (° C.) | 30 | 30 | 30 | 30 |
| Treatment period (min) | 10 | 10 | 10 | 10 |
| Hydrogen peroxide treatment | | | | |
| Hydrogen peroxide (g/L) | 3 | 3 | 3 | 3 |
| NaOH (g/L) | 3 | 3 | 3 | 3 |
| Surface active agent (g/L) | 1 | 1 | 1 | 1 |
| Stabilizer (g/L) | 1 | 1 | 1 | 1 |
| Treatment liquid temperature (° C.) | 90 | 90 | 90 | 90 |
| Treatment period (min) | 15 | 15 | 15 | 15 |

TABLE 10-continued

| | Example | | | |
|---|---|---|---|---|
| | 26 | 27 | 28 | 29 |
| Evaluation | | | | |
| Whiteness (JIS-1991) | 62 | 66 | 72 | 76 |
| Fiber strength (JIS-L-1095) (cN) | 1200 | 1200 | 1200 | 1100 |
| Bleaching uniformity | ○ | ○ | ◎ | ◎ |
| Texture | ○ | ○ | ◎ | ◎ |
| Comprehensive evaluation | Δ | Δ | ○ | ◎ |

TABLE 11

| | Example | | Comparative Example |
|---|---|---|---|
| | 30 | 31 | 3 |
| Wetting step | | | |
| Treatment liquid temperature (° C.) | 25 | 25 | 25 |
| Treatment period (min) | 10 | 10 | 10 |
| Ozone bleaching step | | | |
| Ozone concentration (g/Nm$^3$) | 120 | 120 | 75 |
| Treatment liquid temperature (° C.) | 25 | 25 | 25 |
| Treatment period (min) | 60 | 40 | 40 |
| Citric acid (g/L) | 1 | 1 | 1 |
| Yellowing step | | | |
| Treatment liquid temperature (° C.) | 80 | — | — |
| Treatment period (min) | 10 | — | — |
| Ozone decomposing step | | | |
| Reducing | | | |
| Sodium sulfite (g/L) | 2 | — | — |
| NaOH (g/L) | 1 | — | — |
| Treatment liquid temperature (° C.) | 30 | — | — |
| Treatment period (min) | 10 | — | — |
| Hydrogen peroxide treatment | | | |
| Hydrogen peroxide (g/L) | 3 | 3 | — |
| NaOH (g/L) | 3 | 3 | — |
| Surface active agent (g/L) | 1 | 1 | — |
| Stabilizer (g/L) | 1 | 1 | — |
| Treatment liquid temperature (° C.) | 90 | 90 | — |
| Treatment period (min) | 15 | 15 | — |
| Evaluation | | | |
| Whiteness (JIS-1991) | 78 | 65 | 57 |
| Fiber strength (JIS-L-1095) (cN) | 1000 | 1100 | 1000 |
| Bleaching uniformity | ◎ | ○ | X |
| Texture | ◎ | ○ | X |
| Comprehensive evaluation | ◎ | Δ | X |

The above results indicate that the fabrics of Examples 22 to 31 were generally excellent. However, the fabric of Comparative Example 3 was inferior to the fabrics of Examples 22 to 31 with some evaluation items being practically disadvantageous.

Next, fabrics treated and dried in Examples 23, 24 and 31 and Comparative Example 3 were allowed to naturally stand in a room without temperature control for evaluation of the over-time yellowing. The whiteness levels of the fabrics were measured in conformity with JIS-1991 after a lapse of 1 day, 30 days and 60 days. Further, the whiteness levels of the fabrics were measured in the same manner as described above after a forced dry heating process was performed at 150° C. for 10 minutes. The results are shown in Table 12.

| | Example | | | Comparative Example |
|---|---|---|---|---|
| | 23 | 24 | 31 | 3 |
| Whiteness (JIS-1991) After natural standing in room | | | | |
| 1 day | 77 | 71 | 65 | 57 |
| 30 days | 74 | 69 | 63 | 55 |
| 60 days | 72 | 67 | 62 | 54 |
| After forced heating | 75 | 68 | 63 | 54 |
| Evaluation | ◎ | ○ | Δ | X |

The above results indicate that the fabrics of Examples 23, 24 were substantially free from the over-time yellowing and maintained their whiteness. On the other hand, the fabric of Example 31 not subjected to the intentional yellowing step and the reducing step of the ozone decomposing step suffered from yellowing to some extent. Further, the fabric of Comparative Example 3 subjected neither the intentional yellowing step nor the ozone decomposing step suffered from significant over-time yellowing, and was not suitable for practical use.

INDUSTRIAL APPLICABILITY

The inventive bleached fiber product production method is adapted to bleach a fiber product with the use of ozone which is immediately decomposable and hence is unlikely to remain in an ambient environment and, therefore, is advantageous with a lower environmental load. The produced bleached fiber product is unlikely to suffer from over-time yellowing. Therefore, the present invention is applicable to bleaching of a wide variety of fiber products mainly including natural fibers such as of cotton, hemp and wool and regenerated fibers such as of viscous rayon, which conventionally require a bleaching treatment.

What is claimed is:

1. A bleached fiber product production method for bleaching a fiber product mainly including at least one of a natural fiber and a regenerated fiber to produce a bleached fiber product, the method comprising the steps of:

loading the fiber product into a lidded hermetic vessel serving as a treatment vessel;

forcibly circulating a treatment liquid in contact with the fiber product loaded in the treatment vessel through a forcible circulation pipe attached to the treatment vessel and provided with a circulation pump to thereby wet the fiber product;

supplying an ozone gas into the treatment liquid in a minute bubble form via a gas-liquid mixing/ejecting means, the gas-liquid mixing/ejecting means being selected from an ejector, a vortex pump and a mixing pump, to provide an ozone-containing liquid, and forcibly circulating the ozone-containing liquid in contact with the wetted fiber product through the forcible circulation pipe to thereby bleach the fiber product;

forcibly circulating an ozone decomposing chemical agent liquid in contact with the bleached fiber product through the forcible circulation pipe to thereby decompose ozone; and rinsing the fiber product after the decomposition of the ozone;

wherein an ozone concentration in the treatment vessel is measured over time in the fiber product bleaching step, and maintained within a predetermined range by increasing an ozone gas supply amount if the measured concentration is lower than a predetermined range, and reducing the ozone gas supply amount if the measured concentration is higher than the predetermined range.

2. A bleached fiber product production method as set forth in claim 1, wherein the treatment vessel is a package type treatment vessel in which the fiber product is treated in a packaged form, wherein the treatment liquid, the ozone-containing liquid and the ozone decomposing chemical agent liquid are each caused to repeatedly flow into and out of the packaged fiber product to be forcibly circulated in contact with the fiber product.

3. A bleached fiber product production method as set forth in claim 1, wherein the treatment vessel is a liquid flow type treatment vessel in which the fiber product is transported in a rope form in a liquid stream while being treated in the liquid stream, wherein the treatment liquid, the ozone-containing liquid and the ozone decomposing chemical agent liquid are each used for generating the liquid stream for transportation of the rope-form fiber product and forcibly circulated in contact with the fiber product.

4. A bleached fiber product production method as set forth in claim 1, wherein the treatment vessel is a washer type treatment vessel in which the fiber product is treated while being moved in a rotary drum, wherein the treatment liquid, the ozone-containing liquid and the ozone decomposing chemical agent liquid are each forcibly circulated into and out of the rotary drum in contact with the fiber product.

5. A bleached fiber product production method as set forth in claim 1, wherein the ozone-containing liquid has an ozone concentration of 10 to 300 g/Nm$^3$, wherein the ozone-containing liquid is forcibly circulated at a flow rate of 15 to 90 liters/minute per 1 kg of the fiber product.

6. A bleached fiber product production method as set forth in claim 1, wherein the ozone decomposing chemical agent liquid is a chemical agent liquid mainly containing hydrogen peroxide and an alkali agent.

7. A bleached fiber product production method as set forth in claim 1, wherein the ozone decomposing chemical agent liquid includes a first chemical agent liquid mainly containing a reducing agent and a second chemical agent liquid mainly containing hydrogen peroxide and an alkali agent.

8. A bleached fiber product produced by a production method as recited in claim 1.

9. A bleached fiber product as set forth in claim 8, the bleached fiber product having a whiteness of not lower than 60 (as measured in conformity with JIS-1991) after being allowed to stand at 20° C. to 30° C. for 60 days following the production.

10. A bleached fiber product production method for bleaching a fiber product mainly including at least one of a natural fiber and a regenerated fiber to produce a bleached fiber product, the method comprising the steps of:

loading the fiber product into a lidded hermetic vessel serving as a treatment vessel;

forcibly circulating a treatment liquid in contact with the fiber product loaded in the treatment vessel through a forcible circulation pipe attached to the treatment vessel and provided with a circulation pump to thereby wet the fiber product;

supplying an ozone gas into the treatment liquid in a minute bubble form via a gas-liquid mixing/ejecting means, the gas-liquid mixing/ejecting means being selected from an ejector, a vortex pump and a mixing pump, to provide an ozone-containing liquid, and forcibly circulating the ozone-containing liquid in contact with the wetted fiber product through the forcible circulation pipe to thereby bleach the fiber product;

forcibly circulating hot water heated up to a temperature not lower than 50° C. in contact with the bleached fiber product through the forcible circulation pipe to thereby yellow the bleached fiber product;

forcibly circulating an ozone decomposing chemical agent liquid in contact with the yellowed fiber product through the forcible circulation pipe to thereby simultaneously achieve removal of a yellowing substance from the yellowed fiber product and decomposition of ozone; and rinsing the fiber product after the removal of the yellowing substance and the decomposition of the ozone;

wherein an ozone concentration in the treatment vessel is measured over time in the fiber product bleaching step, and maintained within a predetermined range by increasing an ozone gas supply amount if the measured concentration is lower than a predetermined range, and reducing the ozone gas supply amount if the measured concentration is higher than the predetermined range.

11. A bleached fiber product production method as set forth in claim 10, wherein the treatment vessel is a package type treatment vessel in which the fiber product is treated in a packaged form, wherein the treatment liquid, the ozone-containing liquid, the hot water and the ozone decomposing chemical agent liquid are each caused to repeatedly flow into and out of the packaged fiber product to be forcibly circulated in contact with the fiber product.

12. A bleached fiber product production method as set forth in claim 10, wherein the treatment vessel is a liquid flow type treatment vessel in which the fiber product is transported in a rope form in a liquid stream while being treated in the liquid stream, wherein the treatment liquid, the ozone-containing liquid, the hot water and the ozone decomposing chemical agent liquid are each used for generating the liquid stream for transportation of the rope-form fiber product and forcibly circulated in contact with the fiber product.

13. A bleached fiber product production method as set forth in claim 10, wherein the treatment vessel is a washer type treatment vessel in which the fiber product is treated while being moved in a rotary drum, wherein the treatment liquid, the ozone-containing liquid, the hot water and the ozone decomposing chemical agent liquid are each forcibly circulated into and out of the rotary drum in contact with the fiber product.

14. A bleached fiber product production method as set forth in claim 10, wherein the ozone-containing liquid has an ozone concentration of 10 to 300 g/Nm$^3$, wherein the ozone-containing liquid is forcibly circulated at a flow rate of 15 to 90 liters/minute per 1 kg of the fiber product.

15. A bleached fiber product production method as set forth in claim 10, wherein the ozone decomposing chemical agent liquid is a chemical agent liquid mainly containing hydrogen peroxide and an alkali agent.

16. A bleached fiber product production method as set forth in claim 10, wherein the ozone decomposing chemical agent liquid includes a first chemical agent liquid mainly containing a reducing agent and a second chemical agent liquid mainly containing hydrogen peroxide and an alkali agent.

17. A fiber product bleaching apparatus to be used for a bleached fiber product production method as recited in claim 1, the apparatus comprising:

a lidded hermetic vessel serving as a treatment vessel;

fiber product holder means for loading a fiber product in the treatment vessel;

liquid introducing means for introducing a liquid to the fiber product loaded in the treatment vessel;

a forcible liquid circulation pipe provided with a circulation pump through which the liquid introduced into the treatment vessel is repeatedly taken out of the treatment vessel and introduced again into the treatment vessel to be brought into contact with the fiber product loaded in the treatment vessel;

ozone gas supplying means which supplies an ozone gas generated from an ozone generator in a minute bubble form via a gas-liquid mixing/ejecting means being selected from an ejector, a vortex pump and a mixing pump into the liquid circulated through the forcible liquid circulation pipe to provide an ozone-containing liquid for a bleaching treatment;

chemical agent liquid preparing means which supplies an ozone decomposing agent into the liquid circulated through the forcible liquid circulation pipe to provide an ozone decomposing chemical agent liquid for decomposing ozone;

a liquid outlet pipe through which the liquid present in the treatment vessel is drained out of the treatment vessel; and a gas outlet pipe through which a gas present in the treatment vessel is discharged out of the treatment vessel;

wherein an ozone concentration sensor is provided in the treatment vessel for measuring an ozone concentration in the treatment vessel over time;

wherein the ozone concentration in the treatment vessel is controlled to be maintained within a predetermined range by increasing an ozone gas supply amount if the measured concentration is lower than a predetermined range, and reducing the ozone gas supply amount if the measured concentration is higher than the predetermined range.

18. A fiber product bleaching apparatus as set forth in claim 17, wherein the treatment vessel is a package type treatment vessel in which the fiber product is treated in a packaged form, wherein the liquid forcibly circulated through the forcible liquid circulation pipe is caused to repeatedly flow into and out of the packaged fiber product to be brought into contact with the fiber product.

19. A fiber product bleaching apparatus as set forth in claim 17, wherein the treatment vessel is a liquid flow type treatment vessel in which the fiber product is transported in a rope-form in a liquid stream while being treated in the liquid stream, wherein the liquid forcibly circulated through the forcible liquid circulation pipe is used for generating the liquid stream for transportation of the rope-form fiber product and brought into contact with the fiber product.

20. A fiber product bleaching apparatus as set forth in claim 17, wherein the treatment vessel is a washer type treatment vessel in which the fiber product is treated while being moved in a rotary drum, wherein the liquid forcibly circulated through the forcible liquid circulation pipe is forcibly circulated into and out of the rotary drum in contact with the fiber product.

21. A fiber product bleaching apparatus to be used for a bleached fiber product production method as recited in claim 10, the apparatus comprising:

a lidded hermetic vessel serving as a treatment vessel;

fiber product holder means for loading a fiber product in the treatment vessel;

liquid introducing means for introducing a liquid to the fiber product loaded in the treatment vessel;

a forcible liquid circulation pipe provided with a circulation pump through which the liquid introduced into the treatment vessel is repeatedly taken out of the treatment vessel and introduced again into the treatment vessel to be brought into contact with the fiber product loaded in the treatment vessel;

ozone gas supply means which supplies an ozone gas generated from an ozone generator in a minute bubble form via a gas-liquid mixing/ejecting means being selected from an ejector, a vortex pump and a mixing pump into the liquid circulated through the forcible liquid circulation pipe to provide an ozone-containing liquid for a bleaching treatment;

heating means which heats the liquid circulated through the forcible liquid circulation pipe up to a temperature not lower than 50° C. to provide hot water for a yellowing treatment;

chemical agent liquid preparing means which supplies an ozone decomposing agent into the liquid circulated through the forcible liquid circulation pipe to provide an ozone decomposing chemical agent liquid for simultaneously achieving removal of a yellowing substance and decomposition of ozone;

a liquid outlet pipe through which the liquid present in the treatment vessel is drained out of the treatment vessel; and a gas outlet pipe through which a gas present in the treatment vessel is discharged out of the treatment vessel;

wherein an ozone concentration sensor is provided in the treatment vessel for measuring an ozone concentration in the treatment vessel over time, wherein the ozone concentration in the treatment vessel is controlled to be maintained within a predetermined range by increasing an ozone gas supply amount if the measured concentration is lower than a predetermined range, and reducing the ozone gas supply amount if the measured concentration is higher than the predetermined range.

22. A fiber product bleaching apparatus as set forth in claim 21, wherein the treatment vessel is a package type treatment vessel in which the fiber product is treated in a packaged form, wherein the liquid forcibly circulated through the forcible liquid circulation pipe is caused to repeatedly flow into and out of the packaged fiber product to be brought into contact with the fiber product.

23. A fiber product bleaching apparatus as set forth in claim 21, wherein the treatment vessel is a liquid flow type treatment vessel in which the fiber product is transported in a rope-form in a liquid stream while being treated in the liquid stream, wherein the liquid forcibly circulated through the forcible liquid circulation pipe is used for generating the liquid stream for transportation of the rope-form fiber product and brought into contact with the fiber product.

24. A fiber product bleaching apparatus as set forth in claim 21, wherein the treatment vessel is a washer type treatment vessel in which the fiber product is treated while being moved in a rotary drum, wherein the liquid forcibly circulated through the forcible liquid circulation pipe is forcibly circulated into and out of the rotary drum in contact with the fiber product.

* * * * *